United States Patent [19]

Fleischmann

[11] Patent Number: 4,919,637

[45] **Date of Patent: * Apr. 24, 1990**

[54] MODEL SUBMARINE

[75] Inventor: Lewis W. Fleischmann, Randallstown, Md.

[73] Assignee: Leonard Bloom, Towson, Md.; a part interest

[ * ] Notice: The portion of the term of this patent subsequent to May 2, 2006 has been disclaimed.

[21] Appl. No.: 285,655

[22] Filed: Dec. 12, 1988

Related U.S. Application Data

[63] Continuation-in-part of Ser. No. 865,790, May 22, 1986, Pat. No. 4,826,465.

[51] Int. Cl.[5] ..... A63H 23/04; A63H 27/06; B63G 8/22

[52] U.S. Cl. ..... 446/162; 446/155; 446/164; 446/211; 114/333

[58] Field of Search ..... 446/162, 153, 154, 155, 446/156, 157, 158, 159, 160, 161, 163, 164, 165; 114/333, 332, 331

[56] References Cited

U.S. PATENT DOCUMENTS

| | | | |
|---|---|---|---|
| 1,318,623 | 10/1919 | Wall | 446/162 |
| 2,506,281 | 5/1950 | Sabini | 446/162 |
| 3,046,697 | 7/1962 | Pullen | 446/164 |
| 3,157,145 | 11/1964 | Farris et al. | 114/332 |
| 3,307,290 | 3/1967 | Pederson | 446/164 |
| 3,619,938 | 11/1971 | Tong | 446/156 X |
| 3,952,349 | 4/1976 | Erath et al. | 114/331 |
| 4,241,535 | 12/1980 | Tsukuda | 446/162 X |

FOREIGN PATENT DOCUMENTS

| | | | |
|---|---|---|---|
| 1028789 | 5/1966 | United Kingdom | 446/165 |

*Primary Examiner*—Robert A. Hafer
*Assistant Examiner*—D. Neal Muir
*Attorney, Agent, or Firm*—Leonard Bloom

[57] ABSTRACT

A model submarine has an inherent "fail safe" feature, so that the submarine (if submerged) will rise to its periscope depth in the event the submarine encounters a stationary object, or in the event a power failure occurs. Power is supplied by a single submersible motor-pump unit within a free-flooding hull. The motor-pump unit supplies a pressurized water discharge for, first, forward propulsion of the submarine via the discharge nozzle of an ejector pump; and second, for hydraulic control of the diving and steering maneuvers. The ejector pump has a venturi for aspirating fluid out of the ballast tank. An automatic depth control feature assures that the submarine will level off to a desired predetermined depth when a diving command signal is given; and the desired predetermined depth is adjustable. The model submarine simulates its real-life counterpart, may be enjoyed by the sophisticated hobbyist as well as by the novice, and may be manufactured easily and economically (either fully assembled or in the kit form) for widespread marketing and distribution.

38 Claims, 16 Drawing Sheets

MODEL SUBMARINE

CROSS-REFERENCE TO RELATED APPLICATION

The present application is a continuation-in-part of co-pending application, Ser. No. 865,790, filed May 22, 1986, the disclosure of which is incorporated in its entirety by reference herein.

FIELD OF THE INVENTION

The present invention relates to remotely-controlled model submarines, and more particularly, to a model submarine which realistically simulates the maneuvers of its full size counterpart while either moving on the surface of the water, or at periscope depth, or totally submerged; and wherein the model submarine may be retrieved conveniently in the event a failure occurs, thereby providing an inherent "fail safe" feature.

BACKGROUND OF THE INVENTION

In the technology of model submarines, the prior art has resorted to two different design philosophies, namely: a positive buoyancy system (or "PBS") and a negative buoyancy system (or "NBS"), respectively. Unfortunately, there are serious disadvantages inherent in both designs.

In the PBS system, the model submarine is "trimmed" to be slightly positively buoyant when the ballast tank (or tanks) are fully flooded. If propulsion is lost, the boat will slowly rise to the surface so that at least its periscope is above the surface of the water. Thus, a model submarine employing the positive buoyancy system is "fail safe"; that is, the boat cannot sink to the bottom in the event of a power failure but, rather, may be retrieved by the operator.

However, when submerged, model submarines employing PBS have great difficulty in simulating the maneuvers of its full-size counterpart. This is due, at least in part, to the dynamic forces acting on the bow and stern planes which are used to submerge the boat under the surface of the water. Control of the angle of attack of these planes (in order to maintain a level run at a given depth) is most difficult to achieve, especially if the boat cannot be seen by the operator. Thus, the enjoyment and satisfaction in operating a PBS boat have been one greatly curtailed and sacrificed inn favor of a fail-safe retrieval.

In the NBS system, on the other hand, the model submarine is "trimmed" to be slightly negatively buoyant when the ballast tank (or tanks) are fully flooded. While the intention of the NBS system is to enable the model submarine to more closely simulate the maneuvers of its full-size counterpart, nevertheless, it is difficult to control the model submarine and maintain a level run at a given depth (for the same reasons as the PBS system). Moreover, should propulsion cease or a failure occur, the boat can sink to the bottom of a lake (or other body of water) in which case retrieval can be quite inconvenient or altogether impossible. If the boat cannot be retrieved, a substantial investment (amounting to hundreds of dollars) is lost.

Model enthusiasts have long sought a submarine which can accurately and realistically simulate the maneuvers of its real life counterpart, yet has an inherent fail-safe characteristic, as well as an automatic depth control system which levels the boat upon reaching the command depth.

Neither the PBS or the NBS systems currently employed in model submarines are satisfactory; and because of their inherent disadvantages (primarily, the lack of an automatic depth control feature) the use and enjoyment of model submarines have been greatly curtailed, such that the market for model submarines has been restricted and does not even begin to approach the comparable market for other models, such as model cars, boats and airplanes.

Moreover, the existing model submarines (or kits thereof) tend to be unduly complicated, costly and unreliable; and as a result, the market for model submarines has been restricted even further.

For example, various techniques have been employed to satisfactorily attempt to fill and purge the ballast during diving operations. Many models employ reversible pumps which pump water into or out of one or more ballast tanks. Other models use free flooding of the ballast tank (or tanks) by opening a vent valve which communicates with the top of the tank, thereby allowing water to enter through a grate at the bottom of the tank, and thereby taking on a sufficient quantity of water to submerge the submarine. In order to surface, these models close the vent valve and then purge the water out of the bottom grate of the tank using compressed air, Freon or the like. To aid in trimming, these models usually resort to at least two ballast tanks, one fore and one aft; and each ballast tank is provided with its own respective flooding and purging means. Alternatively, to aid in trimming, some models utilize a weight carried by a servo-controlled travelling lead screw which shifts the weight, thereby altering the model's center of gravity. In such methods, the weight is usually positioned in a ballast tank. These design arrangements (heretofore resorted to in the prior art) are complicated, costly and unreliable.

Additionally, most of the submarine kits presently on the market also require various separate watertight compartments in order to house the electric motors, electronics, servo-motors and (often) the batteries. Watertight shaft seals are therefore required at bulkhead penetrations for propeller shafts, servo-actuator linkages and controls, wire penetrators and the like. These bulkhead penetrations are all potential leakage sites which could lead to short circuiting, flooding and power loss, thereby possibly resulting in the loss of the model submarine. Thus, these penetrations require precise sealing arrangements to effect the required leak-tight integrity, thereby adding unnecessary cost and ultimately detracting from reliability of the product.

In my previous U.S. Pat. No. 2,914,887 issued on Dec. 1, 1959 and entitled "Toy Submarine", a battery-operated electric motor drives a conventional propeller for forward movement of the submarine. A ballast tank (below the sail) has a valve for admitting water into the ballast tank. The valve is connected to a float connected to a lever. When the float lever is flipped upwardly, the boat rides on the surface of the water; and when the float lever is pushed down, water enters into the ballast tank, and the boat submerges to its periscope depth. The float lever may be held down by a latch, if desired, but the boat cannot dive below its periscope depth. While satisfactory for the purposes intended, nevertheless, it will be appreciated that the model disclosed in my earlier '887 patent (vintage 1959) does not have the sophisticated technology, nor the improved features and advantages contributing to the marketability of the present invention.

Further representative of the prior art are the following patent references:

| Inventor(s) | U.S. Pat. No. |
|---|---|
| Hueber et al | 2,022,642 |
| Lord | 2,044,088 |
| Gordon | 3,010,255 |
| Presnell | 3,036,403 |
| Parken et al | 3,165,390 |
| Gibson | 3,181,272 |
| Chalom | 3,545,886 |
| Germany | 2,525,253 |
| Germany | 3,244,565 |
| France | 830,268. |

None of these patent references, nor any other prior publications or commercial uses known to the applicant herein, are completely satisfactory for the purposes intended; but rather, have inherent disadvantages and deficiencies which seriously curtail the use and enjoyment of model submarines and, ultimately, their market acceptance.

SUMMARY OF THE INVENTION

Accordingly, it is an object of the present invention to provide a model submarine which alleviates the disadvantages and deficiencies of the prior art by combining the fail-safe feature of the positive buoyancy system ("PBS") with an automatic depth control system, thereby providing realistic maneuverability similar to its full-size counterpart, and thereby substantially enhancing the use and enjoyment of model submarines.

It is another object of the present invention to provide a model submarine which will be readily appreciated by sophisticated model enthusiasts; yet will be readily affordable, thereby greatly expanding its use and enjoyment.

It is yet another object of the present invention to provide a model submarine available either fully assembled or in kit form, which is greatly expands the acceptance and marketability of model submarine.

It is a further object of the present invention to provide a model submarine which is rugged and reliable, simple in design, and relatively inexpensive to manufacture.

It is a still further object of the present invention to provide, in a model submarine, a single submersible motor-pump unit which takes in ambient water from a free-flooding hull and provides a pressurized water discharge constituting the sole power source for forward propulsion of the submarine, as well as diving, surfacing and steering maneuvers, and wherein ambient water in the free-flooding hull constitutes the hydraulic fluid for controlling all of the submarine's maneuvers.

It is, again, an object of the present invention to provide an adjustable automatic depth control feature; so that when the submarine dives, it will ultimately level off to a desired predetermined submerged depth.

It is, again, another object of the present invention to provide a model submarine having a fail-safe feature; such that in the event forward propulsion is interrupted (as when the boat encounters an obstruction) or in the event the motor-pump unit fails, as if the battery becomes discharged—while the boat is fully submerged—the boat will automatically rise to the surface of the water, with its periscope just above the surface of the water; and, thereafter (at this "periscope depth") the boat may be retrieved conveniently.

In accordance with the teachings of the present invention, there is herein illustrated and described, a preferred embodiment of a model submarine having a hull provided with a ballast tank and further provided with a sail and a periscope. The hull, which is shaped to resemble its "real life" counterpart, has a plurality of apertures formed therein, such that the interior of the hull is free-flooding. With the flood valve on the ballast in its closed position, the submarine is adapted to float on the surface of the water when the submarine is initially placed n the water and ambient water enters through the apertures and into the free-flooding hull. A sealed battery is within the hull, and a submersible motor-pump unit is also within the hull and is adapted to be energized by the battery. The motor pump-unit has an intake means in communication with the interior of the hull and further has a pressurized discharge means; such that the motor-pump unit, when energized, continually draws ambient water out of the free-flooding hull, and such that the ambient water is replenished in the hull through the apertures therein. An ejector pump is carried by the hull. The ejector pump has an inlet port connected to the pressurized discharge means of the motor-pump unit and further has a discharge nozzle communicating with the ambient water externally of the hull. The continuous discharge of the ambient water through the discharge nozzle of the ejector pump and out of the hull facilitates the forward propulsion of the submarine in the water. A ballast tank is provided within the hull, and a conduit means communicates the ballast tank with the ejector pump. The conduit means includes a vacuum port, such that when the ejector pump discharges ambient water, a suction is created in the vacuum port, thereby causing the ejector pump to aspirate fluid out of the ballast tank. A first selectively-operable valve means, responsive to a first command signal, communicates the ballast tank with the interior of the free-flooding hull. The water flows into the ballast tank at a faster rate than the rate at which water is aspirated out of the ballast tank by the ejector pump, such that the ballast tank becomes fully filled with ambient water. A buoyancy means within the free-flooding hull is adapted to trim the model submarine to a slightly positive buoyancy when the ballast tank is fully flooded, such that the submarine is still slightly buoyant and is adapted to partially submerge to a periscope depth just under the surface with only its periscope above the water. Articulatable diving planes are carried by the submarine externally thereof and are adapted to have a neutral position defined by a substantially zero angle of attack; and a second selectively-operable means, responsive to a second command signal, articulates the diving planes to cause the submarine to dive below periscope depth. A rudder is provided on the hull; and a third selectively-operable means, responsive to a third command signal, controls the rudder. A receiver means on the submarine receives the respective command signals from a remote transmitter for selectively controlling the first, second and third selectively-operable means, respectively.

In the preferred embodiment, the first selectively-operable means (for communicating the ballast tank with the interior of the free-flooding hull) comprises a selectively-operable flood control valve means including a first diaphragm actuator; the second selectively-operable diving initiating means includes a second diaphragm actuator (for articulating the diving planes); and the third selectively-operable means comprises a selectively-operable steering control means including a third diaphragm actuator (for controlling the rudder).

Each of the first, second and third diaphragm actuators are actuated by respective solenoid-type shuttle valves. Each shuttle valve has an input port connected to the pressurized (auxiliary) discharge of the motor-pump unit, a pair of output ports connected to respective sides of the diaphragm actuator, and a pair of vents for venting the opposite side of the diaphragm actuator.

In an alternate embodiment, these solenoid actuated shuttle valves and diaphragm actuators are replaced with servo motors, respectively.

In the selectively-operable flood-control valve means, an actuator rod is carried by the first diaphragm actuator, a plug constituting a flood control valve is carried by the rod, and an inlet aperture constituting a valve seat is formed on the ballast tank to cooperate with the flood control valve. The flood control valve and the inlet aperature are sufficiently large to allow ambient water to enter into the ballast tank from the free-flooding hull, when the flood control valve is lifted off of its valve seat, at a faster rate than the rate at which water is aspirated out of the ballast tank by the ejector pump, so that the ballast tank may flood completely.

The submarine further has a pivot shaft (and pivot arm) mounted within the sail and connected to the articulatable diving planes for conjoint pivotable movement. The selectively-operable diving initiating means includes a second solenoid-actuated shuttle valve for actuating the second diaphragm actuator. A first vertical push-pull rod is carried by the second diaphragm actuator and is connected through a tension spring to one end of the pivot arm; and the other end of the pivot arm is connected to the diaphragm means responsive to ambient water pressure for sensing the depth to which the submarine has submerged.

In the preferred embodiment, the means responsive to ambient water pressure (for sensing the depth to which the submarine has submerged) includes a second vertical rod having a pair of ends, one of which is connected to the other end of the pivot arm. An actuator includes an air diaphragm connected to the other end of the second rod; the actuator includes an upper portion above the air diaphragm and a lower portion below the air diaphragm. The lower portion of the actuator defines an entrapped air chamber having a tension spring therein, and the upper portion of the actuator has at least one opening formed therein and communicating with the interior of the free-flooding hull. As a result, water is admitted into the upper portion of the actuator housing (when the submarine is in the water) thereby referencing the trapped air pressure in the lower portion of the actuator, and thereby initially referencing one atmosphere air pressure, the magnitude of which increases at increasing depths to which the submarine is submerged below the surface of the water. This counterforce (together with the tension of the springs) tends to bias the push-pull rod which is connected to the other end of the pivot arm. As a result, the pivot arm (and hence the diving planes connected thereto) pivot in a direction where spring tension forces and air pressure induced forces are in equilibrium.

Preferably, a depth limiting collar is threadably received on the first vertical push-pull rod (which is connected to the hydraulically-operated diaphragm actuator) such that the position of the collar on the push-pull rod may be adjusted. The collar is adapted to engage the actuator to provide a stop, thereby limiting the extent to which the push-pull rod may be lowered, and thereby limiting the pivotable movement of the pivot arm and the diving planes connected thereto. This structure provides an adjustable depth limiting feature for the submarine.

Preferably, the hull has an aft portion provided with fixed diving planes, the fixed diving planes serving only as a stabilizer.

Preferably, the rudder includes an upper rudder and a lower rudder, respectively. A pivot rod joins the upper and lower rudders, and an eccentric arm is carried by the pivot rod between the upper and lower rudders. A horizontal push-pull rod has one of its ends connected to the eccentric arm, and the other end of the rod is connected to the third diaphragm actuator. Resilient means biases the third diaphragm actuator to its central neutral position, thereby returning the rudders to their neutral position when the steering command is removed.

Preferably, the free-flooding hull has top and bottom surfaces, and the plurality of apertures constitute vent holes formed in both the top and bottom surfaces, respectively. The hull includes a watertight compartment for housing the receiver means, and the remainder of the hull is completely free-flooding.

Preferably, the buoyancy means comprises closed cell styrofoam for trimming the submarine to a slightly positive buoyancy when the ballast tank is fully flooded. The styrofoam is placed within the hull such that the respective vectors for the center of buoyancy and the center of gravity fall on substantially the same vertical line. In the preferred embodiment, the center of buoyancy is disposed above the center of gravity.

Preferably, the sealed battery is disposed within the envelope of the ballast tank, the ballast tank thereby forming a shroud for the battery; and the battery and the ballast tank are located substantially at the center of the hull, thereby minimizing pitching movements as the ballast tank is flooded or is being purged.

Preferably, the single motor-pump unit comprises an encapsulated motor driving a centrifugal impeller pump. The water intake means of the motor-pump unit is provided with a screen; and the pressurized discharge of the motor-pump unit has a "main" portion connected to the ejector pump, and further has "auxilliary" portions connected to the respective solenoid shuttle valves.

Preferably, the ejector pump is mounted in the lower aft portion of the hull, such that the discharge nozzle of the ejector pump extends externally of the hull. The ejector pump includes a venturi portion communicating with the vacuum port in the conduit to the ballast task, thereby aspirating water or air out of the ballast tank as the pressurized water discharge of the motor-pump unit flows out of the discharge nozzle of the ejector pump.

Viewed in another aspect, the present invention provides (in a model submarine having diving and steering control mechanisms, respectively) the combination of a free-flooding hull and a single motor-pump unit in the hull. The motor-pump unit provides the sole motive power for propulsion of the submarine and for the diving, surfacing and steering maneuvers, respectively, and ambient water in the free-flooding hull provides the hydraulic fluid for activating the diving and steering control mechanisms.

Viewed in yet another aspect, the present invention provides (in a model submarine) the combination of: (1) a motor-pump unit energized by a battery; (2) means assuring that the submarine will rise to periscope depth for convenient retrieval in the event that forward propulsion ceases, or in the event that the motor-pump unit fails, or the battery is discharged, thereby providing a fail-safe feature; and (3) an automatic depth control means for leveling the submarine and for limiting the maximum depth to which the submarine may submerge.

Viewed in yet still another aspect, the present invention provides a model submarine having a free-flooding hull, a ballast tank within the hull, and a sealed battery within the ballast tank envelope. A submersible motor-pump unit within the hull is adapted to be energized by the battery in the ballast tank. The battery and the ballast tank are disposed substantially centrally of the hull; and the hull has closed cell foam therein for trimming the submarine to a slightly positive buoyancy when the ballast tank is fully flooded, such that the submarine (when submerged) will automatically rise to its periscope depth in the event that the motor-pump fails or if the battery is discharged, thereby allowing the submarine to be retrieved and providing a fail-safe feature.

Viewed in a further aspect, the hull has a foam means therein for trimming the submarine to a slightly positive buoyancy, and the foam is disposed in the hull such that the center of buoyancy and the center of gravity vectors fall on substantially the same vertical line. Preferably, the center of buoyancy is above the center of gravity.

These and other objects of the present invention will become apparent from a reading of the following specification taken in conjunction with the enclosed drawings.

DESCRIPTION OF THE PREFERRED EMBODIMENTS

Figure 1:
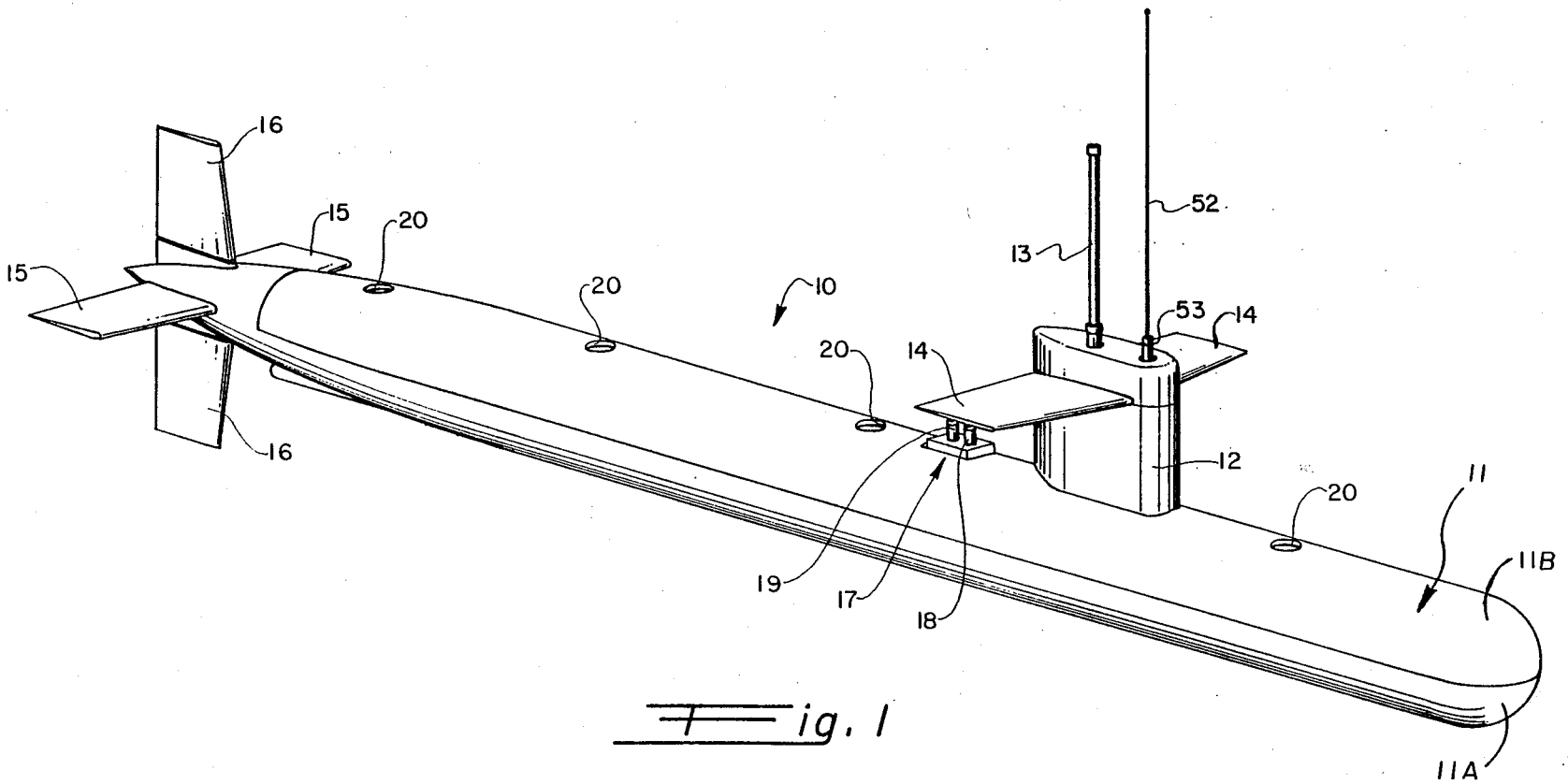
FIG. 1 is a perspective view of the model submarine of the present invention.

With reference to FIG. 1, there is illustrated the model submarine 10 of the present invention. This model submarine 10, which uses the positive buoyant system ("PBS"), has a two-piece hollow hull 11 constructed of a suitable material, such as molded fiberglass or other molded plastic material. Preferably, the model 10 is shaped and formed to simulate the physical appearance of its life-size counterpart. However, any suitable shape may be employed if desired—even a fish, such as a shark—consonant with the teachings of the present invention.

With this in mind, the model submarine 10 generally includes a sail 12 (sometimes referred to as a "conning tower"), a periscope 13, articulatable diving planes 14 carried by the sail 12, fixed stern planes 15 for stabilizing purposes only, and an articulatable rudder 16 for steering control. The diving planes 14 and rudder 16 are selectively-operable under respective remotely-transmitted command signals from the operator (as hereinafter described in detail). The submarine 10 is also provided with an on/off switch housing 17 having a motor-pump switch 18 and an electronics switch 19.

With reference again to FIG. 1, and with further reference to FIGS. 2–6, the hull 11 has a lower housing portion 11A and a complementary upper housing portion 11B serving as a cover for the lower housing 11A and joined thereto along a common horizontal plane. Each of the complementary mating portions 11A and 11B of the hull 11 has a plurality of apertures (or vent openings) 20 formed therein. When the submarine 10 is placed in the water, the water enters through the apertures 20 and displaces the air in the hull 11, such that the hull 11 is free-flooding.

The free-flooding hull 11 is provided with respective layers of foam 21 in the upper housing portion 11B above a ballast tank 22. The amount of foam 21 and its location in the hull 11 assures that with the ballast tank 22 completely flooded (as hereinafter described) the submarine 10 will be slightly positively buoyant and will be submerged in the water to its "periscope depth", such that only the periscope 13 is above the surface of the water. Preferably, this foam 21 comprises closed cell rigid styrofoam 21. The styrofoam 21 is relatively inexpensive and is readily available commercially; and, since the submarine 10 is not intended to dive to relatively deep depths, the styrofoam 21 is well suited for the purposes intended. However, other types of material are equally applicable to achieve the desired positive buoyancy, consonant with the teachings of the present invention.

Figure 2:
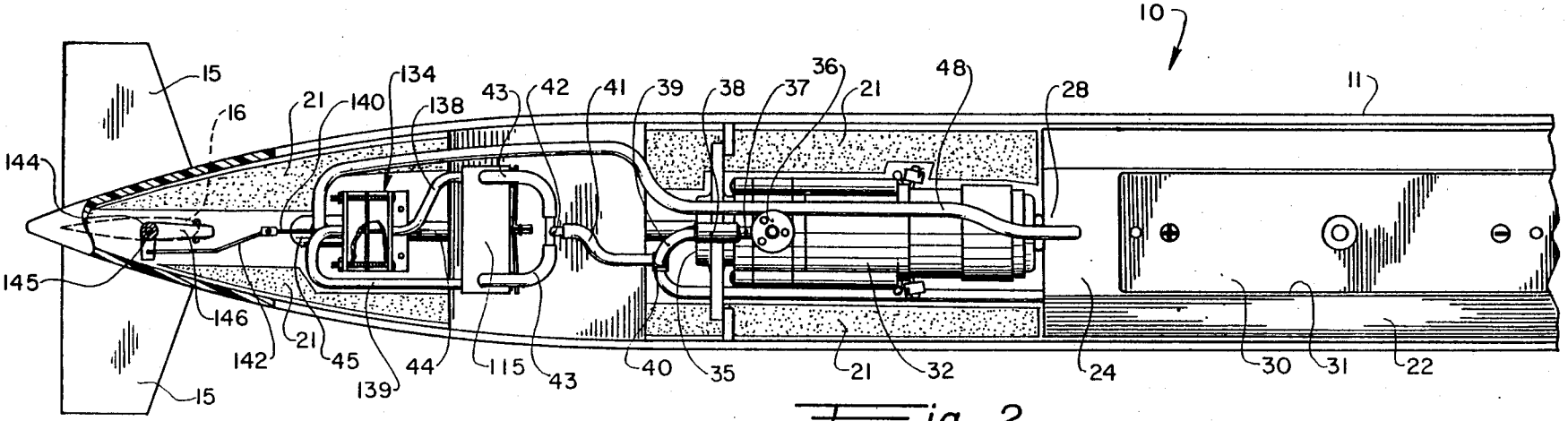
FIG. 2 is a top plan view of the aft section of a preferred embodiment of the model submarine, wherein the upper portion of the hull has been removed to illustrate the inner construction of the model submarine and its major components.
Figures 4, 5, 6:
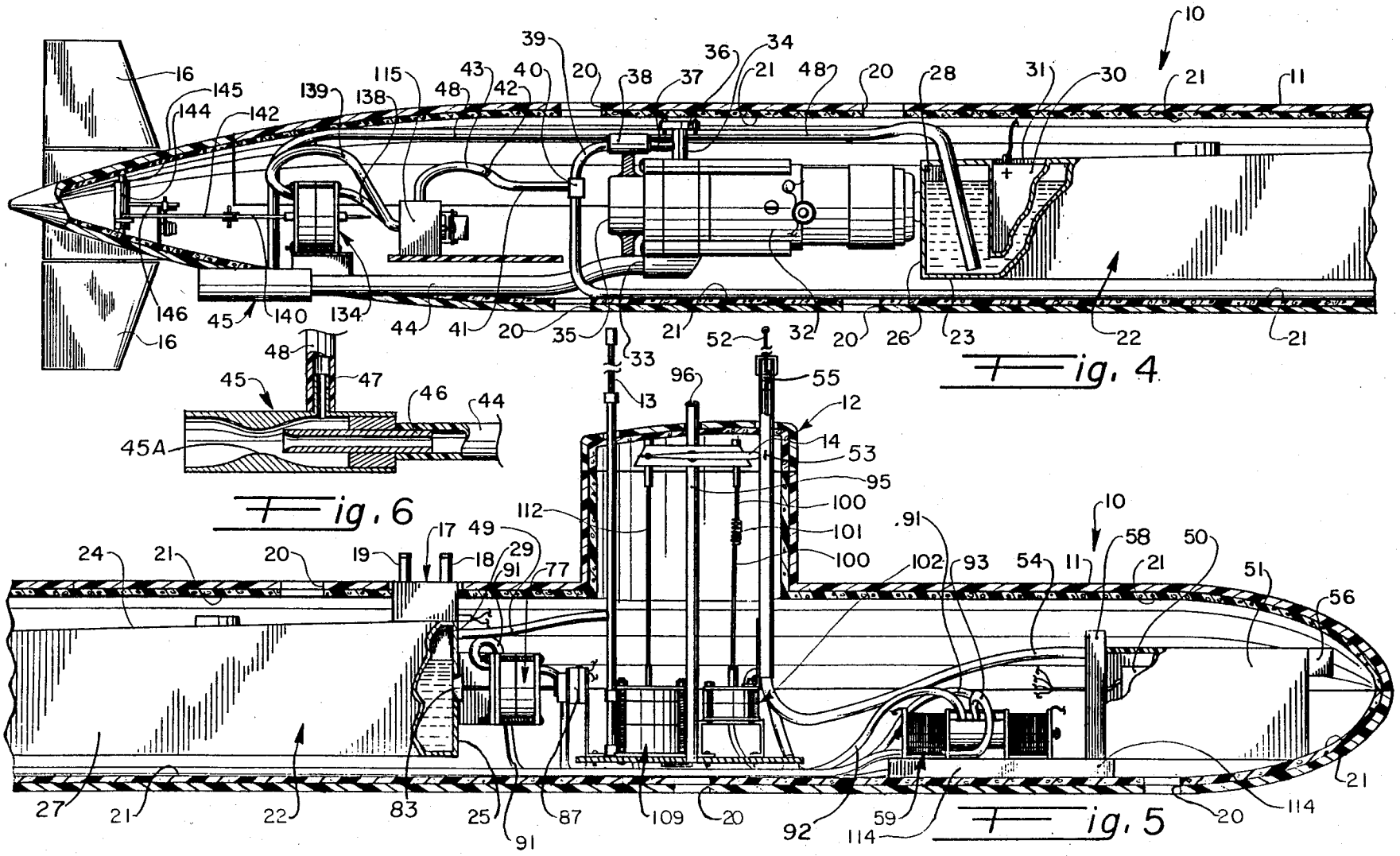
FIG. 4 is a longitudinal sectional view of the aft section thereof.
FIG. 5 is a longitudinal sectional view of the fore section thereof.
FIG. 6 is a longitudinal cross-sectional view of the ejector pump of FIG. 4, drawn to an enlarged scale.

The ballast tank 22 is disposed substantially centrally within the hull 11, as shown more clearly in FIG. 2, 4 and 5. The ballast tank 22 has a base 23, a sloped top wall 24, a forward wall 25, a rear wall 26 and respective side walls 27. The sloped top wall 24 of the ballast tank 22 has a lowermost point 28 (see FIG. 4) and an uppermost point 29 (see FIG. 5). The ballast tank 22 is sealed (thus having an "envelope") and water flows into and out of the ballast tank 22 (as hereinafter described).

A battery 30 (or batteries) supply power to the submarine 10. The battery 30 is sealed and is disposed within the ballast tank 22, such that the ballast tank envelope forms a shroud around the battery 30. The battery 30 is substantially coincident with the center of buoyancy of the submarine 10.

The overall structural arrangement of the major components of the submarine 10 (including the foam 21, ballast tank 22, battery 30, etc.) is such that the center of buoyancy and center of gravity vectors fall on substantially the same vertical line, with the center of buoyancy being disposed above the center of gravity.

A single submersible motor-pump unit 32 is located towards the aft section of the free-flooding hull 11. The motor-pump unit 32, which is readily available, drives a centrifugal impeller pump; the centrifugal impeller pump is conventional, and hence the details thereof have been omitted for ease of illustration.

With reference again to FIGS. 2 and 4, and with further reference to FIG. 14, the motor-pump unit 32 has a pressurized "main" discharge port 33 (constituting a propulsion outlet port) and further has an "auxiliary" pressurized discharge port 34 for activating the hydraulically-activated controls (as hereinafter described in detail). The motor-pump unit 32 has an inlet port 35; preferably, the inlet port 35 is provided with a suitable filter, such as a mesh screen (not shown herein). The auxiliary discharge port 34 has a valve 36 which permits the motor-pump unit 32 to purge itself of air (before initial start up). An internal flap (not shown) closes the valve 36 when water pressure impinges upon it to allow air to escape when the motor-pump unit 32 is "off" and ambient water floods the housing of the motor-pump unit 32. The auxiliary pressurized discharge of the motor-pump unit 32 (past the valve 36) flows through a conduit 37, filter 38, conduit 39, T-fitting 40, conduit 41, T-fitting 42 and conduits 43. Conduit 39 provides the motive power (pressurized ambient water) for the submerging and diving, respectively, and conduits 43 provide the motive power (pressurized ambient water) for the steering control, as hereinafter described in detail.

With reference again to FIGS. 2–6, the water discharged from the propulsion outlet port 33 of the motor-pump unit 32 flows via conduit 44 to an ejector pump 45 (shown more clearly in FIG. 6). The ejector pump 45—which has no moving parts—is mounted in the lower aft portion of the hull 11 and has a discharge nozzle 46. As the pressurized water flows through the discharge nozzle 46 of the ejector pump 45 (and into the ambient water surrounding the submarine 10) a "reaction jet" is provided which results in the forward propulsion of the submarine 10. Rearwardly of its discharge nozzle 46, the ejector pump 45 has a reduced "hour glass" venturi portion 45A. As the pressurized water flows out of the discharge nozzle 46 and through the venturi 45A of the ejector pump 45, the venturi 45A creates a vacuum or suction at a suction port 47. This suction port 47 has a suction conduit 48 leading to the lowermost portion of the ballast tank 32, as shown more clearly in FIG. 4. When the submarine 10 surfaces, the highest portion of the suction conduit 48 is above the water line, thereby preventing water from siphoning back into the ballast tank 22 when the motor-pump unit 32 is not running, and when the suction conduit 48 is full of air above the water line. The periscope 13 also functions as a telescopic vent tube for the ballast tank 22, and the highest point of the ballast tank 22 has a vent hose 49 (see FIG. 5) communicating the periscope 13 (for both air and water therebetween). The air or water aspirated from the ballast tank 22 (by the suction effect of the ejector pump 45) is replaced by air drawn from the atmosphere into the ballast tank 22 via periscope 13 and vent hose 49, respectively, when the top of the periscope 13 is above the surface of the water; and if the submarine 10 is fully submerged, water will be drawn down the periscope 13 into the ballast tank 22.

A multi-channel receiver 50 is located towards the bow (fore section) of the submarine 10 for receiving radio frequency ("R.F.") command signals from a remote portable multi-channel transmitter held by the operator for complete remote control of the submarine 10. The transmitter, being conventional, has been omitted for ease of illustration. As shown more clearly in FIGS. 3 and 5, the receiver 50 is suitably sealed in a watertight housing 51. An "on board" antenna 52 extends upwardly from the forward portion of the sail 12. The antenna 52 has a lower portion supported by an antenna post 53. This antenna post 53 houses a shielded coaxial signal cable 54 connected to the receiver 50 for transmission of the R.F. signal. A radio signal contact spring 55 maintains electrical contact between the antenna 52 and the cable 54. The receiver housing 51 has metal radiator fins 56 which extend therefrom into the hull 11. These fins 56 transmit heat from the receiver 50 (and from the receiver's batteries, not shown) to the water within the free-flooding hull 11. The receiver 50 has multi-pin contacts 57 housed in a watertight connector housing 58 for transmitting the control signal commands to the various components of the model submarine 10 to thereby maneuver the submarine 10. [However, it will be appreciated by those skilled in the art that other means for transmitting remote-control signals or even on-board pre-programmed signals may be employed, consonant with the teachings of the present invention.]

Figure 3:
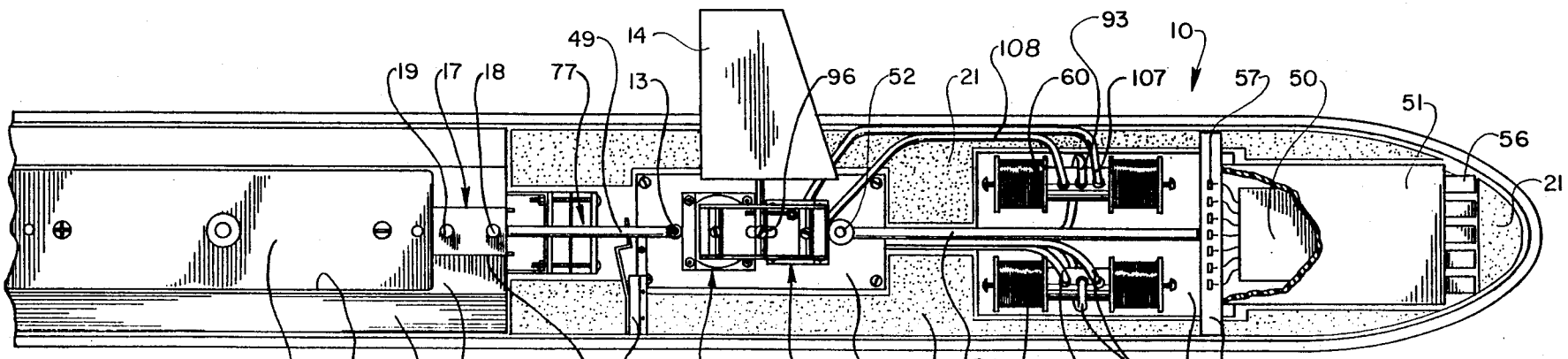
FIG. 3 is a top plan view of the fore section of the embodiment of FIG. 2, wherein (again) the upper portion of the hull has been removed for ease of illustration.

As shown more clearly in FIG. 3, a valve 59 (for ballast control) and a separate valve 60 (for control of the diving planes) are positioned in the hull 11 between the sail 12 and the connector housing 58. Preferably, these valves 59 and 60 are solenoid-actuated shuttle valves.

Figure 7:
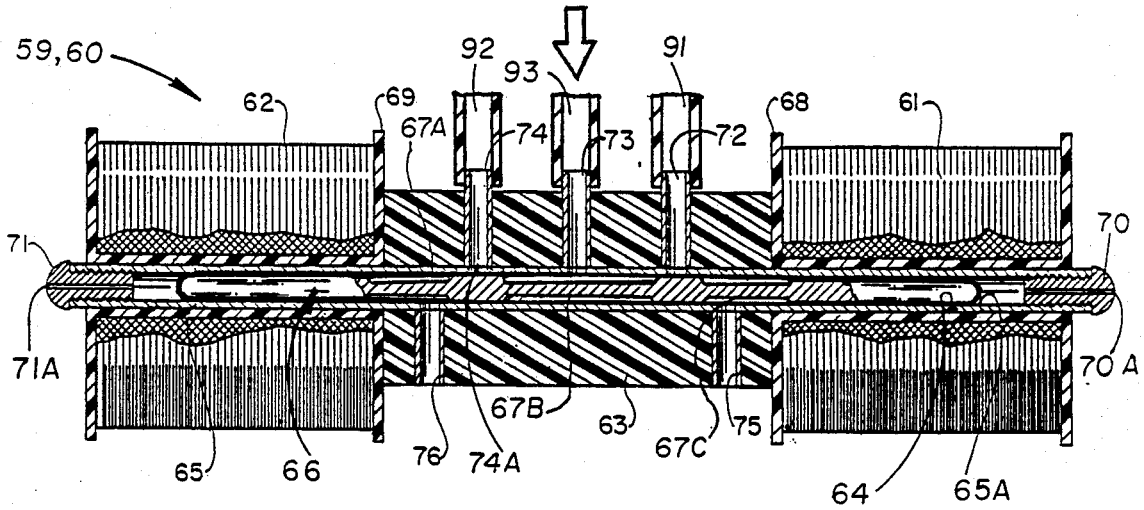
FIG. 7 is a cross-section view of one of the solenoid-actuated shuttle valves employed in the preferred embodiment of the present invention, the valve being shown in its intermediate or "neutral" position.

With reference to FIG. 7, these solenoid-actuated shuttle valves 59 and 60 are potted or impregnated in resin so as to be water impermeable. Each of the valves 59 and 60 has a pair of spaced-apart solenoid coils including a fore coil 61 and an aft coil 62, with a central housing main body portion 63 therebetween. The coils 61 and 62 and the body portion 63 have a central bore 64 receiving a bushing 65 therein. The bushing 65 further has a bore 65A therein. The bushing 65 is formed of a nonmagnetic material and has respective threaded ends. A spool 66 is received in the bore 65A in the bushing 65 for axial sliding movement therein. Spool 66 has a plurality of annular grooves 67A, 67B and 67C (for purposes hereinafter described in detail). The coils 61 and 62 are wound on bobbins (or spools) 68 and 69, respectively. Restraining screws 70 and 71 are carried by the respective threaded end portions of bushing 65, thereby limiting the alternate axial sliding movement of the spool 66 therein. These limiting screws 70 and 71 have longitudinal through holes 70A and 71A, respectively, formed therein. These holes 70A and 71A act as vents for water ingressing and egressing as spool 66 moves fore and aft. The body portion 63 has three bores which are provided with tubes 72 , 73 and 74, respectively, extending beyond the body portion 63. The body portion 63 also has two downwardly (oppositely) extending bores provided with tubes 75 and 76, respectively. Each of the tubes 72–76 communicates with the interior of the bushing 65 through respective holes formed in the bushing 65; one of these holes is denoted by 74A in FIG. 7. Tube 73 receives pressurized water from the auxiliary discharge of the motor-pump unit 32; tubes 72 and 74 lead to respective sides of a diaphragm actuator (as hereinafter described); and tubes 75 and 76 constitute vents for return flow from the diaphragm actuator.

Figure 7A:
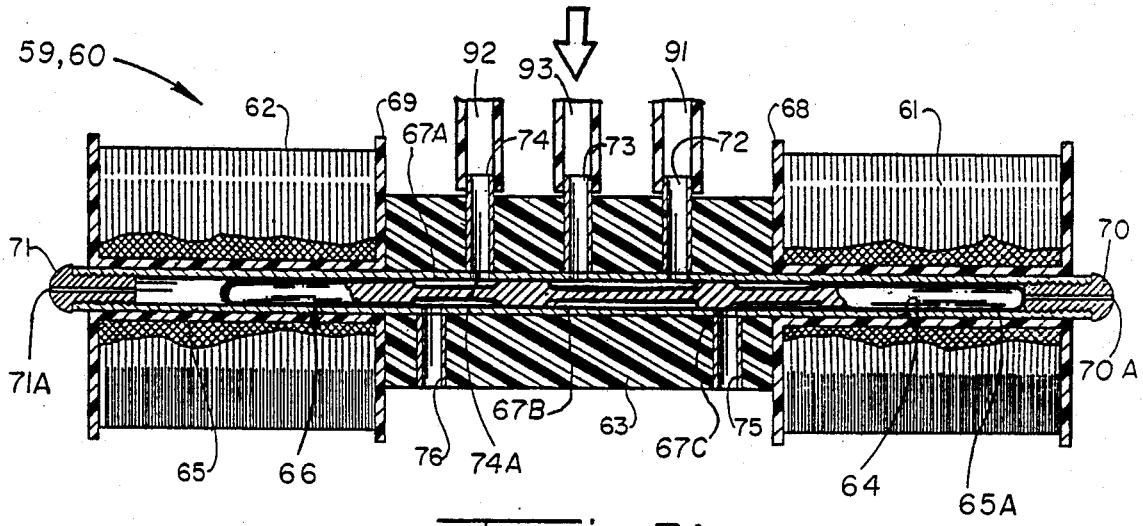
FIG. 7A corresponds FIG. 7, but shows the valve in one of its operative positions.
Figure 7B:
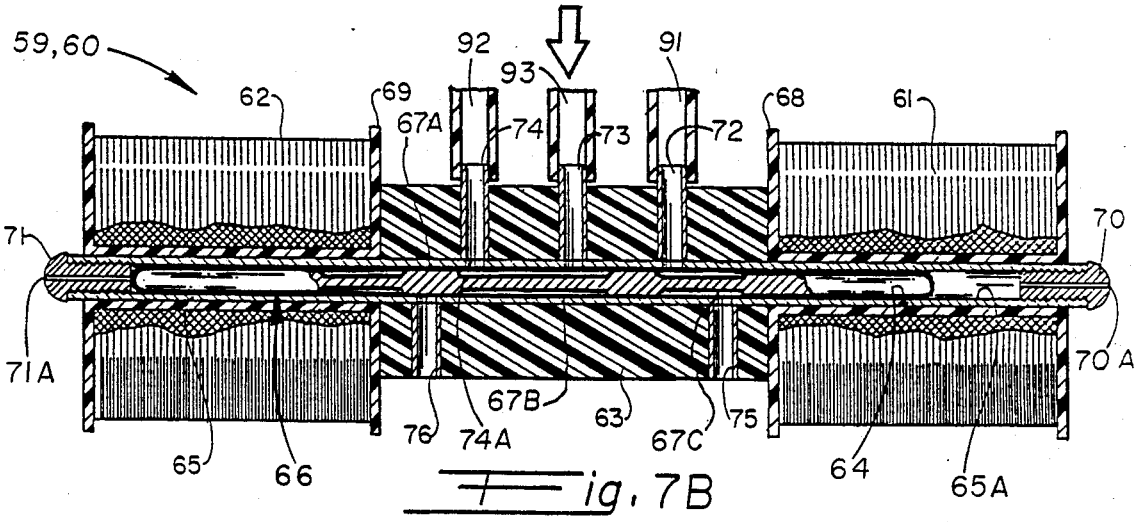
FIG. 7B corresponds to FIG. 7, but shows the valve in its alternative operative position.

In FIG. 7, the spool 66 is shown in a "neutral" position, wherein none of the tubes 72–76 are in communication with each other. However, it will be appreciated that, upon actuation of either coil 61 or coil 62, the spool 66 (as viewed in FIG. 7) will be attracted to the right or to the left, respectively, such that the spool 66 has two alternate positions corresponding to the alternate command signals that energize coils 61 and 62, respectively. When the spool 66 moves to the left (see FIG. 7A) corresponding to energization of coil 62, tube 73 will be in communication with tube 74 for supplying pressurized water to one side of the (respective) diaphragm actuator, via annular groove 67B; and, simultaneously, tube 72 will be in communication with tube 75, via annular groove 67C, for venting the other side of the diaphragm actuator. Conversely, and as shown in FIG. 7B, when spool 66 moves to the right corresponding to energization of coil 61, tube 73 is now in communication with tube 72 via annular groove 67B for supplying pressurized water to the other side of the respective diaphragm actuator; and, simultaneously, tube 74 is in communication with tube 76 via annular groove 67A for venting the one side of the respective diaphragm actuator.

Figure 8:
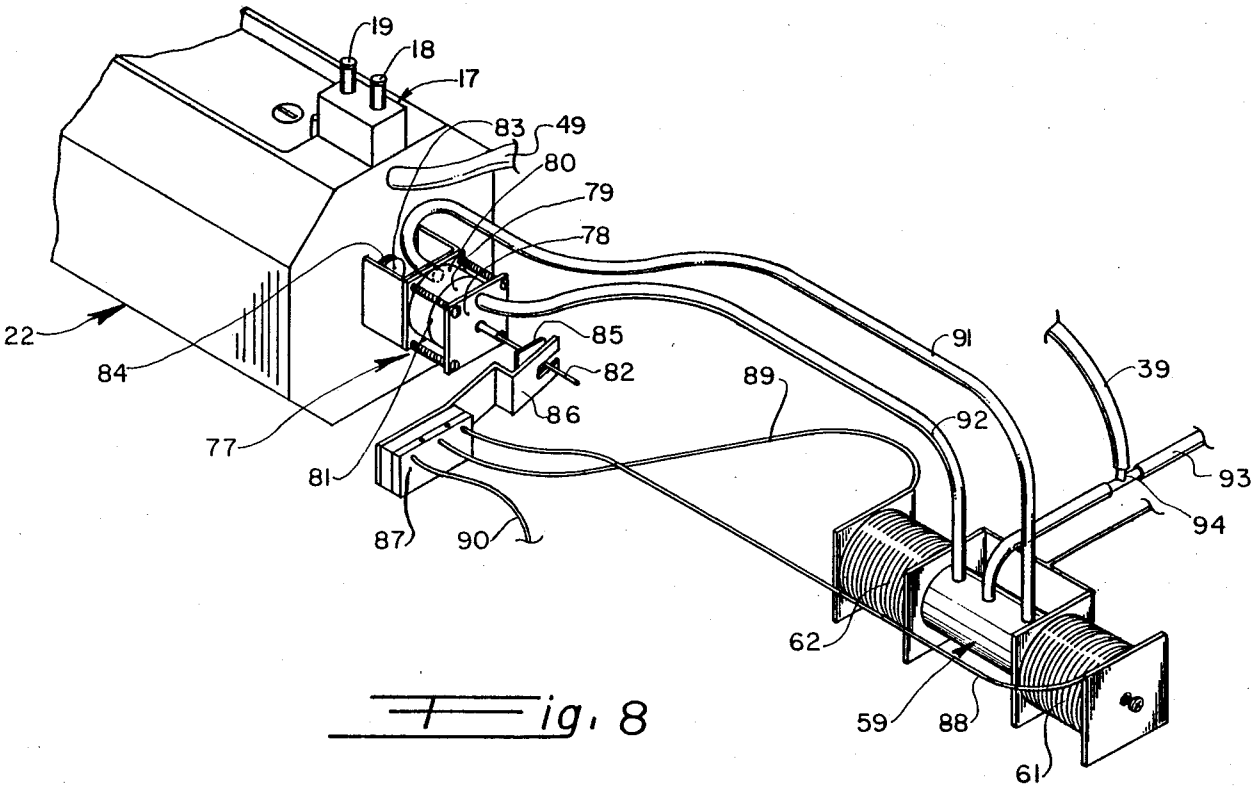
FIG. 8 is a perspective view, with parts broken away, of the ballast tank actuator system of the preferred embodiment, as removed from the hull for ease of illustration.

With reference again to FIG. 5, and with further reference to FIG. 8, the ballast tank 22 has a diaphragm actuator 77 constituting a flood control valve means. The actuator 77 includes a housing 78 having a forward chamber 79, an aft chamber 80, and an actuator diaphragm 81 therebetween. The diaphragm 81 carries a shaft 82 for conjoint movement therewith between a first closed position and a second open position. The rearward end of the shaft 82 carries an aperture plug valve 83 cooperating with an aperture 84 forming a valve seat on the forward wall 25 of the ballast tank 22. When the valve 83 is in a first closed position (seated on its valve seat 84) the flow of water from the free-flooding hull 11 into the ballast tank 22 is prevented; and when the valve 83 is in its second position (unseated from its valve seat 84) the ambient water in the free-flooding hull 11 is allowed to flow into the ballast tank 22.

As previously noted, the size of the aperture 84 is sufficient to allow ambient water from the free-flooding hull 11 to flow into the ballast tank 22 at a rate which is faster than the rate at which the water is aspirated out of the ballast tank 22 by the ejector pump 45, thereby submerging the submarine 10 to its periscope depth.

As shown more clearly in FIG. 8, the opposite (forward) end of the shaft 82 carries a switch actuator 85. When the shaft 82 reaches its fully extended (second) open position, the switch actuator 85 contacts an elongated arm 86 of a waterproof microswitch 87. Microswitch 87 is electrically connected to the electrical contacts 57 associated with receiver 50 by an insulated cable 90.

A conduit 91 is connected between tube 72 of valve 59 and aft chamber 80 (of actuator 77) for fluid communication therebetween. A conduit 92 is connected between tube 74 of valve 59 and fore chamber 79 (of actuator 77) for fluid communication therebetween. A conduit 93 is connected between tube 73 of the ballast solenoid control valve 59 and tube 73 of the diving control valve 60 for fluid communication therebetween. Conduit 93 has a "T" fitting 94 connected to conduit 39 to receive the auxilliary pressurized discharge from the motor-pump unit 32, as shown more clearly in FIG. 14.

Figure 9:
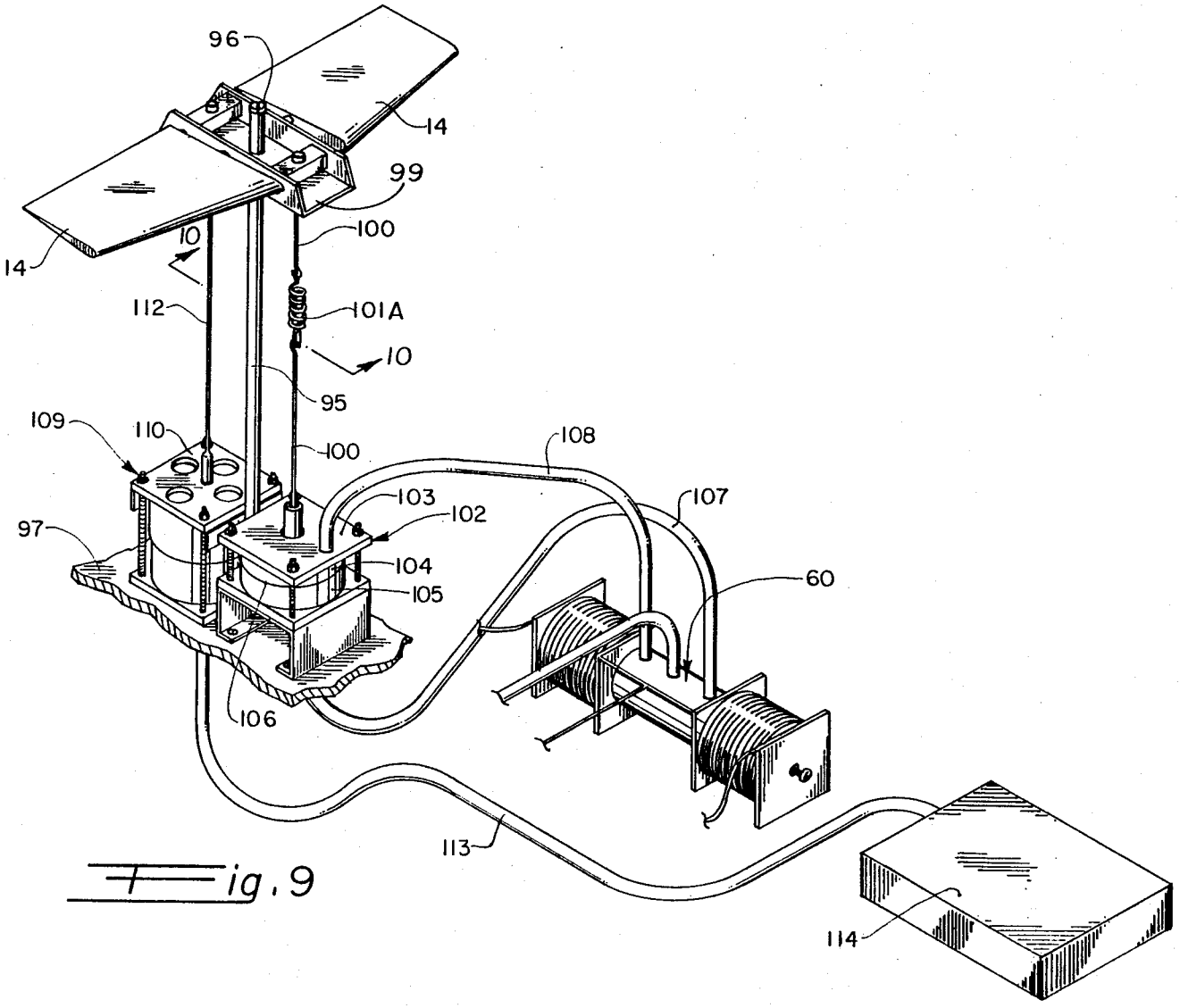
FIG. 9 is a perspective view of the diving plane actuator and automatic depth control system of the preferred embodiment, again as removed from the hull for ease of illustration.
Figure 10A:
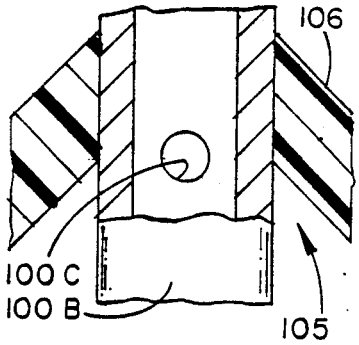
FIG. 10A is an enlarged portion of FIG. 10, showing a port formed in a hollow tube secured to the lower end of a vertical push-pull rod.
Figure 10:
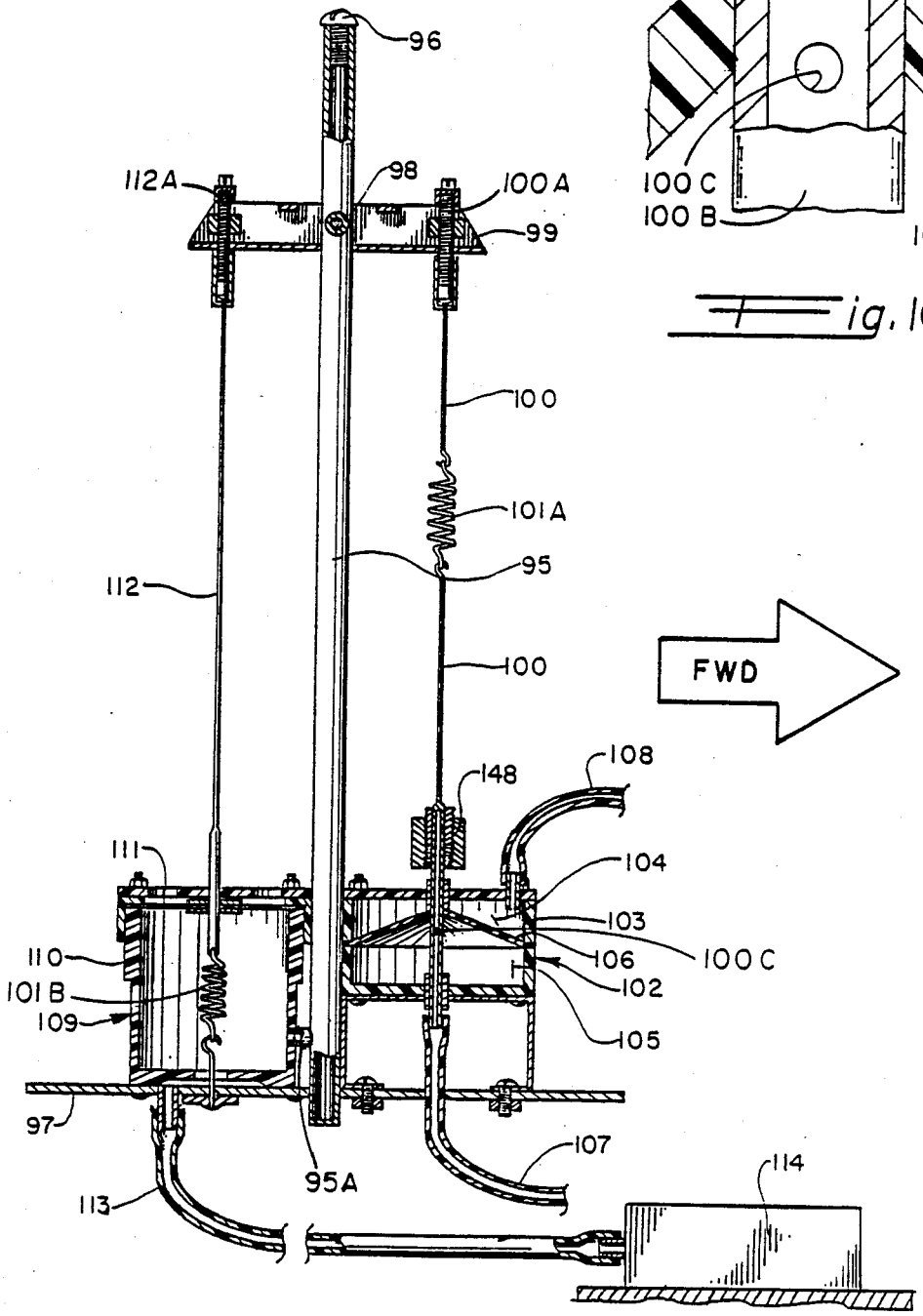
FIG. 10 is a longitudinal sectional view thereof, taken along the lines 10—10 of FIG. 9 and drawn to an enlarged scale.
Figure 11:
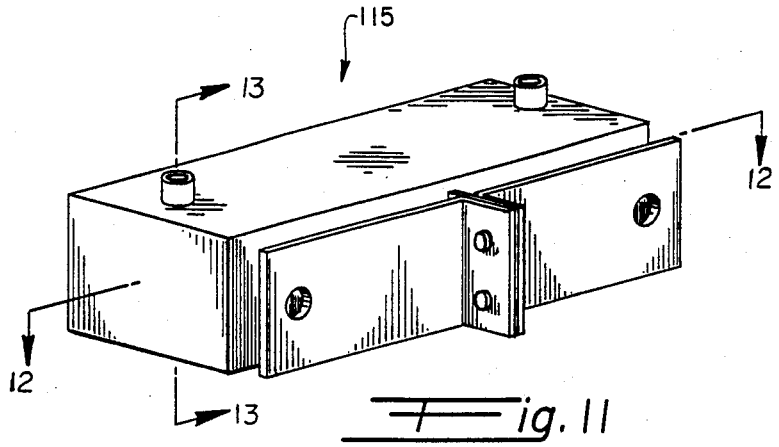
FIG. 11 is a perspective view of a flapper valve used to control the rudder for actuating the rudder and thus steering the model submarine.
Figure 12:
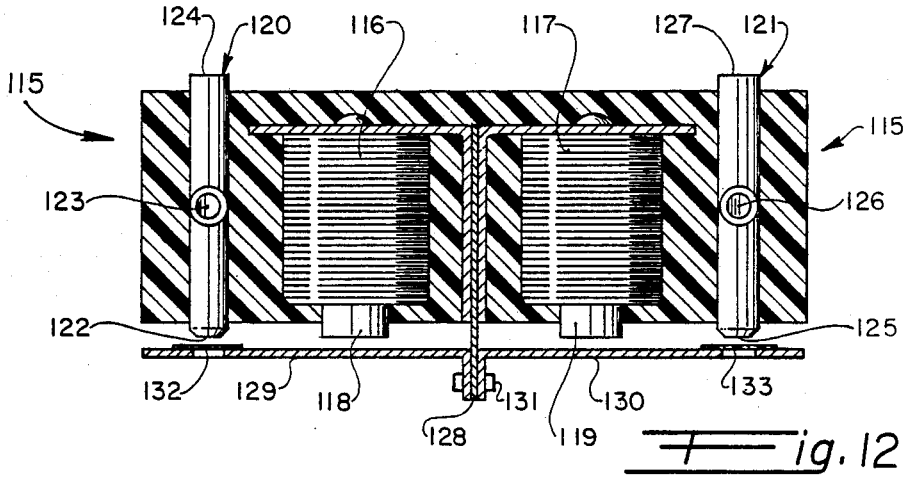
FIG. 12 is a cross-sectional view thereof, taken along the lines 12—12 of FIG. 11 and drawn to an enlarged scale.
Figure 13:
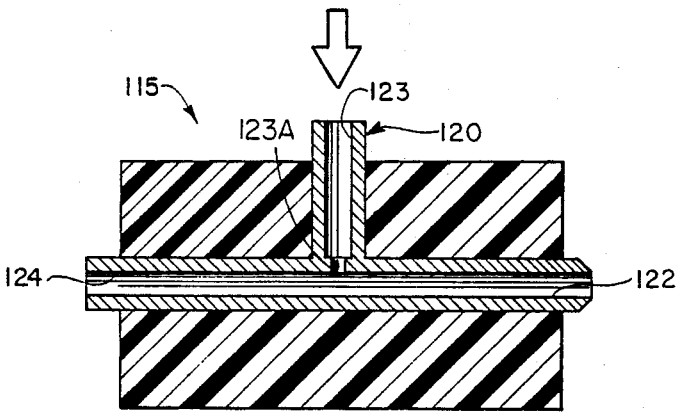
FIG. 13 is another cross-section view thereof, taken along lines 13—13 of FIG. 11 and drawn to an enlarged scale.

With reference again to FIG. 5, and with further reference to FIGS. 9 and 10 there is illustrated the mechanism for controlling the forward articulatable diving planes 14 of the model submarine 10. A hollow tube 95 has a top portion provided with a seal screw 96. The bottom of the tube 95 is mounted on a base 97 which is secured to the bottom of the hull 11. An automatic depth control mechanism uses reference air supplied by the atmosphere upon opening of the seal screw 96; and, after the submarine has been placed into the water for several minutes, closing screw 96. Tube 95 thus serves, first, as a vent conduit to the atmosphere for the supply of reference air at current atmospheric pressure and, second, as a mechanical support for the articulatable diving planes 14. The upper portion of tube 95 carries a pivot shaft 98 (see FIG. 10) which carries a pivot arm 99 for conjoint pivotal movement. Each side of the pivot shaft 98 is secured to a respective diving plane 14 for conjoint tilting movement, clockwise and counter-clockwise, as viewed in FIG. 10. A first vertical push-pull rod 100 has an upper portion pivotably (and adjustably) mounted on the forward portion of the pivot arm 99. The push-pull rod 100 has respective sections connected by a spring 101A. The initial position of the push-pull rod 100 may be adjusted by rotating a screw 100A, in either a first downward direction wherein the downward tension (towards the base 97) is decreased; or in a second (opposite) upward direction, wherein the downward tension towards the base 97 is increased.

A diving plane diaphragm actuator 102 has a housing 103 positioned on the forward portion of the base 97. The housing 103 has an upper chamber 104, a lower chamber 105, and a diaphragm 106 therebetween. As shown more clearly in FIG. 10A, a hollow tube 100B is secured to the lower end of the push-pull rod 100, and tube 100B is provided with a port 100c for communicating with the lower chamber 105. The lower end of the push-pull rod 100 is secured to the diaphragm 106 for conjoint vertical movement therewith. A conduit 107 is positioned between the lower chamber 105 and tube 72 in the diving solenoid control valve 60 for fluid communication therebetween. A conduit 108 is positioned between the upper chamber 104 and the tube 74 of valve 60 for fluid communication therebetween.

A reference air-filled diaphragm actuator 109 has a housing 110 secured on the rearward portion of base 97. Diaphragm housing 110 has a diaphragm 111 (FIG. 10) secured to the lower end of a second vertical rod (constituting a connecting rod 112) for conjoint movement therewith. A conduit 113 is positioned between the diaphragm housing 110 and a metal air accumulator housing 114 for air pressure communication therebetween. A small conduit 95A is disposed between tube 95 and housing 110 for air pressure communication therebetween. In this manner, a pressure equilibrium—between the air trapped inside the diaphragm housing 110, tube 95, air accumulator 114, and the ambient water in the hull—is effected. The upper end of rod 112 is secured to the rearward portion of the diving plane mounting arm 99. Rod 112 may be selectively adjusted by rotating screw 112A in either a first direction (wherein tension is increased) or in a second opposite direction (wherein tension is decreased upon spring 101B). [The function and operation of this mechanism 109 hereinafter will be discussed more fully.]

Returning to FIGS. 2–5, and with further reference to FIGS. 11–14, a flapper valve 115 is disposed rearwardly of the motor-pump unit 32. The flapper valve 115 preferably has a molded plastic housing having coils 116 and 117, respectively, positioned side-by-side in the housing. These coils 116 and 117 have cores 118 and 119, respectively, and are each electromagnetic 1200-ohm coils. The flapper valve 115 further has hollow "T" tubes 120 and 121, respectively, which are positioned outboard of coils 116 and 117, respectively. "T" tube 120 has a front port 122, a top port 123, and a rear port 124 formed thereon and protruding therefrom. "T" tube 121 has a front port 125, a top port 126, and a rear port 127 formed therein and protruding therefrom. A leaf-spring fulcrum 128, fabricated from a magnetically permeable metal, forms a magnetic path connecting the coils 116 and 117. The fulcrum 128 extends from the forward face of the valve 115. A pair of flappers 129 and 130 (which are also fabricated of a magnetically permeable metal) are pivotably secured, respectively, to the left and right sides of the fulcrum 128 by a rivet 131. Flappers 129 and 130 are also made from a magnetically permeable material. The flappers 129 and 130 extend in the direction of "T" tubes 120 and 121, respectively, and carry rubber seals 132 and 133, respectively. When either flapper (129 or 130) is attracted towards its respective coil (116 or 117) a respective rubber seal (132 or 133) thereon will be drawn towards—and will contact and block—the corresponding front port (122 or 125) of the respective "T" tubes 120 and 121. At the base of tubes 123 and 126, respectively, there is a reduced diameter orifice to restrict the flow of water therethrough. Each orifice has the same diameter.

Figure 14:
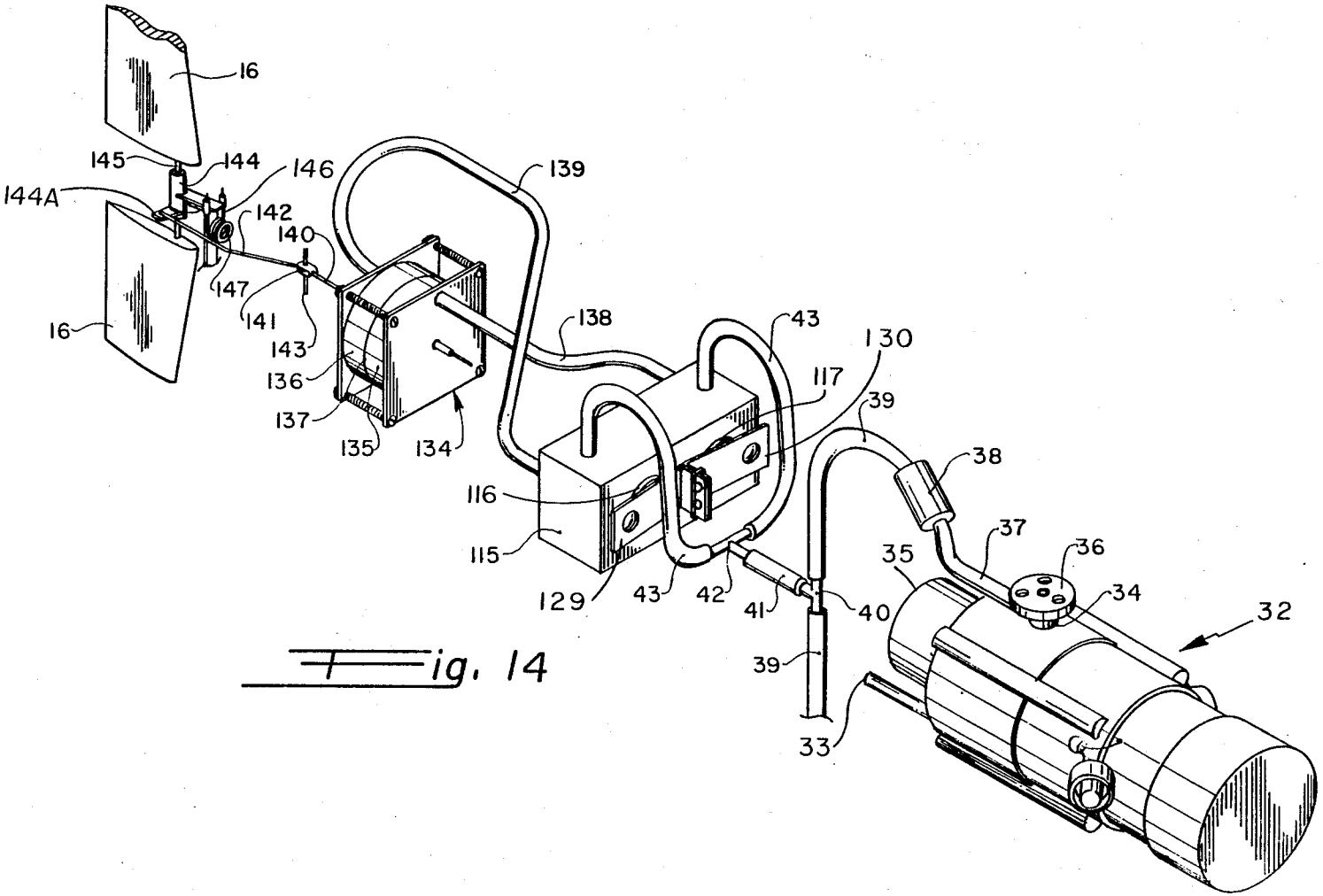
FIG. 14 is a perspective view of that part of the open-circuit hydraulic control system positioned rearwardly of the ballast tank, showing the single motor-pump unit, flapper valve, actuator, and rudder for steering control.

As shown more clearly in FIG. 14, conduit 43 is connected between the top port 123 (of "T" tube 120) and the top port 126 of "T" tube 121) for fluid communication therebetween. Positioned rearwardly of flapper valve 115, is a steering (rudder) diaphragm actuator 134. Steering actuator 134 includes a forward chamber 135, a rearward chamber 136 and a diaphragm 137 positioned therebetween. A conduit 138 is connected between the forward chamber 135 and the rear port 127 of "T" tube 121 for fluid communication therebetween. A conduit 139 is connected between the rearward chamber 136 and the rear port 124 of "T" tube 120 for fluid communication therebetween.

A forward steering rod 140 is disposed centrally through the actuator 134, and the longitudinal axis of the rod 140 is positioned perpendicularly to the vertical plane of the actuator 134 and is coupled to the diaphragm 137 for conjoint axial movement therewith. The rearward end of rod 140 has a clevis-joint 141, and a rearward steering rod 142 is connected to the clevis-joint 141 by a pin 143. The rearward (opposite) end of rod 142 is secured to a first arm 144A of an "L"-shaped sleeve 144. A vertical steering shaft 145 (in the aft portion of the hull 11) carries respective (upper and lower) rudders 16 for conjoint movement therewith. Steering shaft 145 carries a sleeve 144 thereon having an arm 144B aligned with a spring mounting bracket 146. The spring mounting bracket 146 carries a torsion spring 147. Torsion spring 147 biases movement of arm 144B, hence sleeve 144 and shaft 145, and (ultimately) rudders 16 into a neutral position which is aligned substantially with the longitudinal axis of the hull 11.

OPERATION

Figure 15:
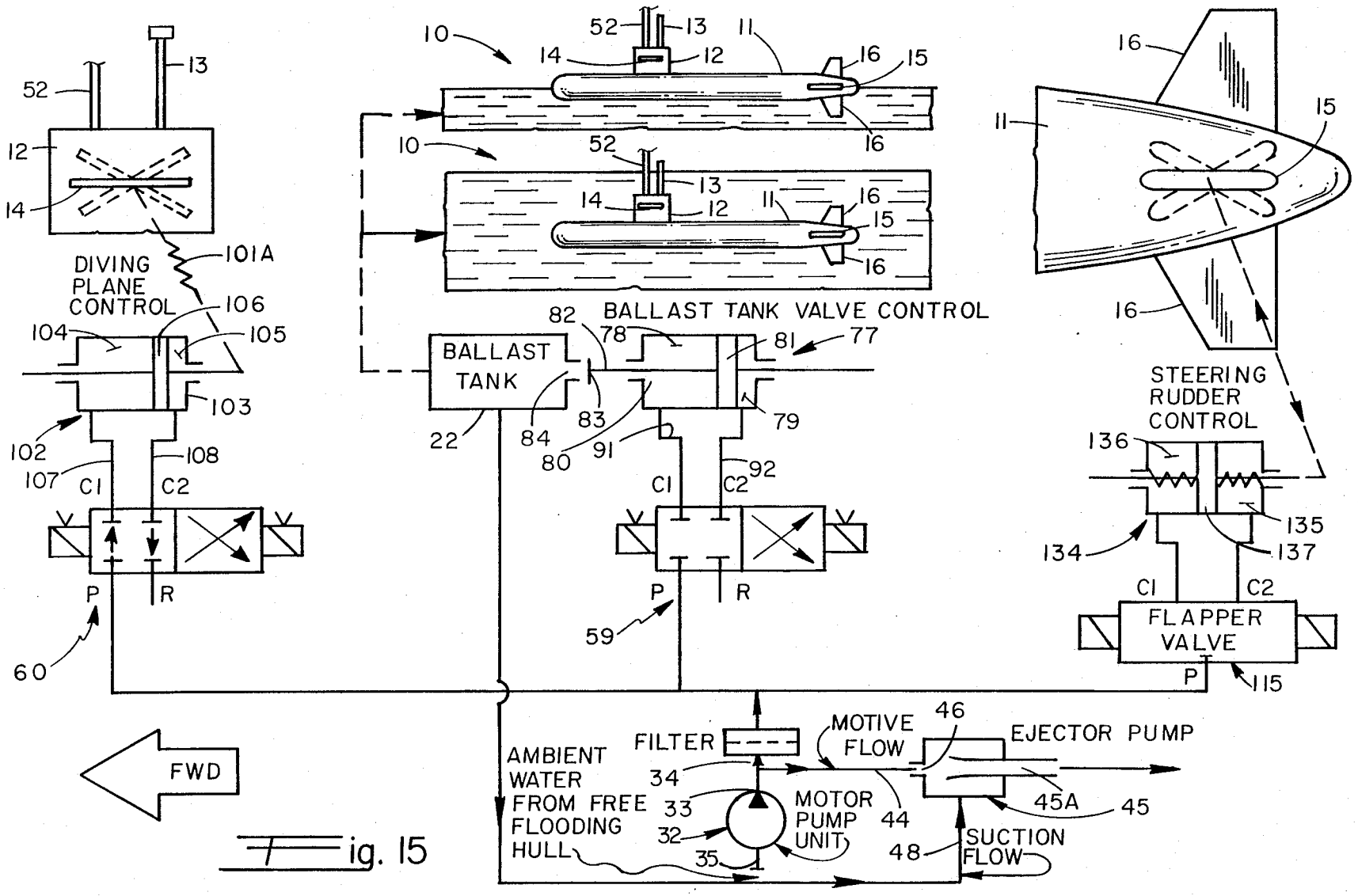
FIG. 15 is a schematic diagram illustrating the motive power of the model submarine as well as the hydraulically-actuated controls for submerging, diving and steering, respectively.
Figure 16:
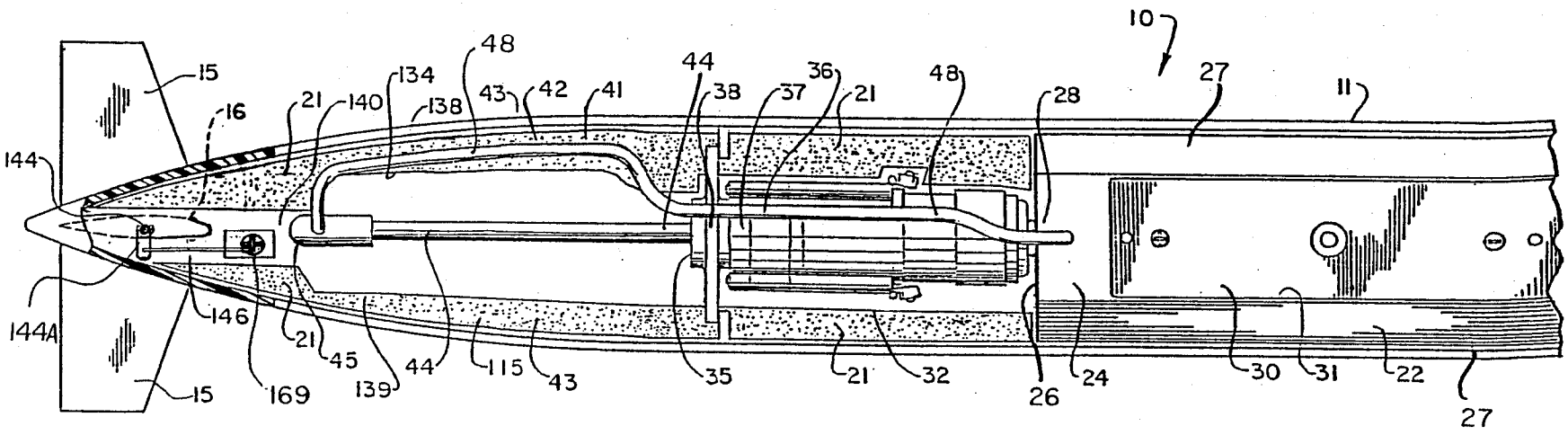
FIGS. 16 and 17 are top plan views, respectively, of the aft section and the fore section of a second embodiment of the model submarine of the present invention, the upper portion of the hull being removed for ease of illustration.
Figure 17:
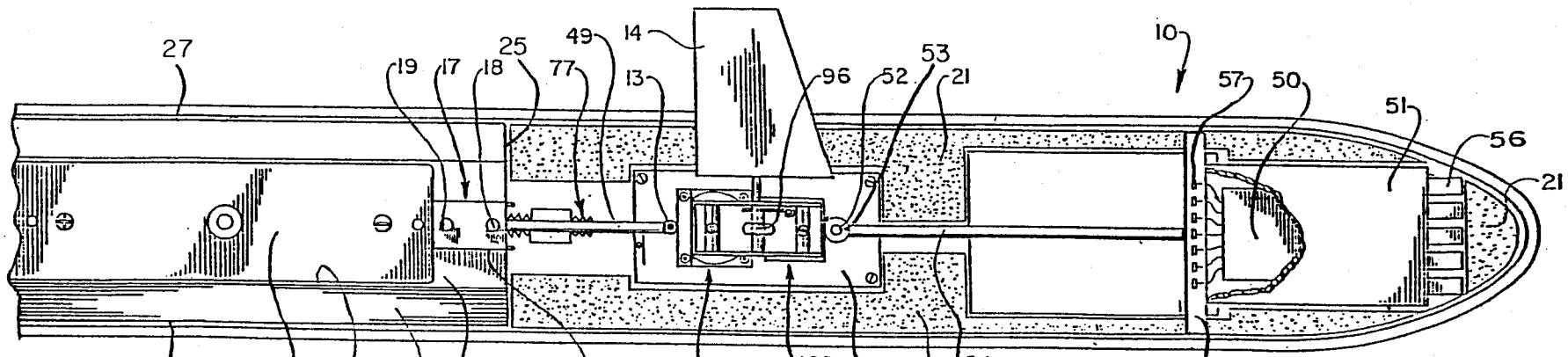
Figures 18, 19, 20:
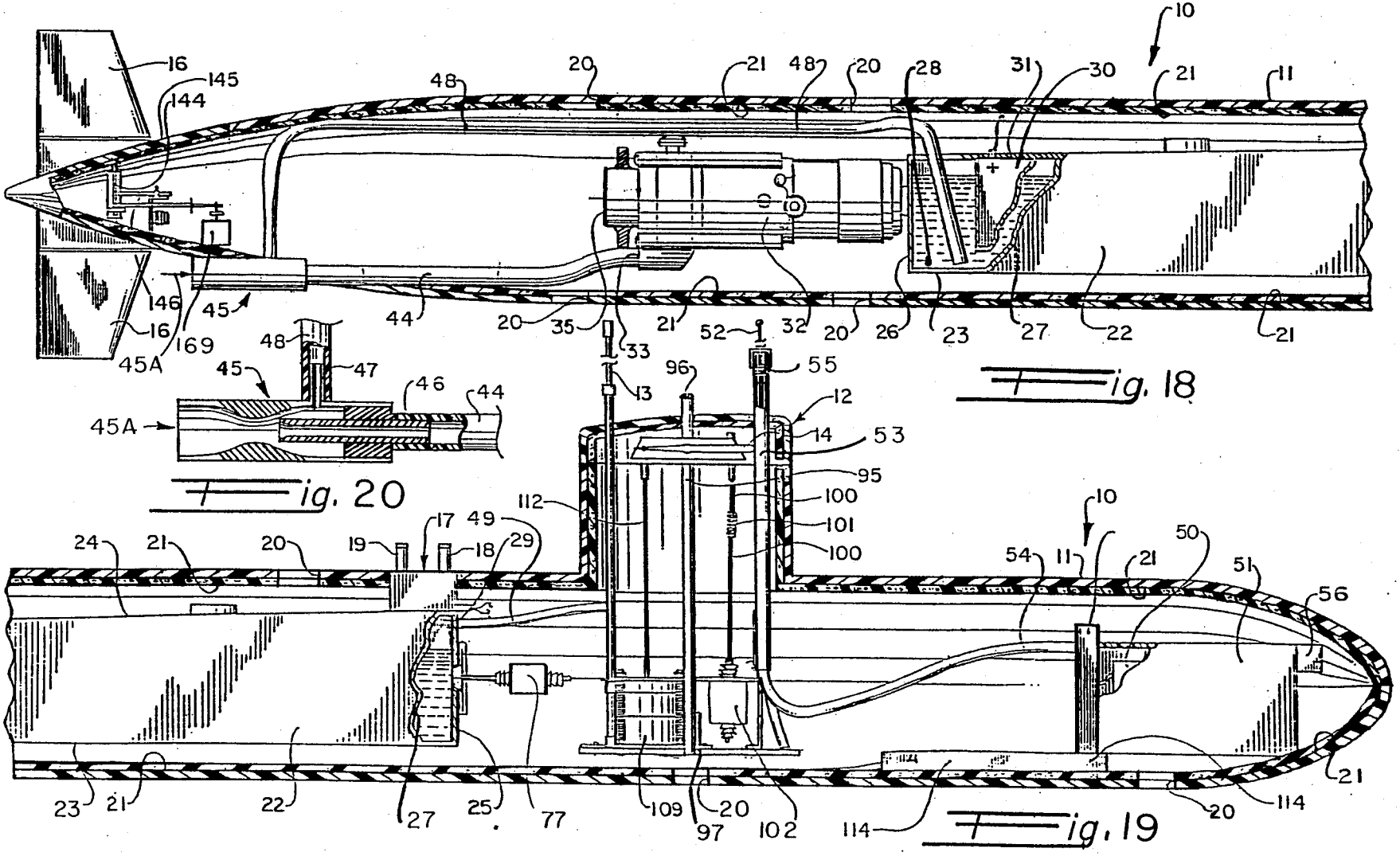
FIGS. 18 and 19 are longitudinal cross-sectional views of the aft and fore sections of the model submarine of FIGS. 16 and 17, respectively.
FIG. 20 is a longitudinal cross-sectional view of the ejector pump in this second embodiment of the present invention.

Having thus discussed the mechanical structure of the model submarine 10 of the present invention, the operation thereof will now be discussed (in detail) with reference to the drawings and, in particularly, to the hydraulic schematic diagram of FIG. 15, so that the features and advantages of the present invention may be made readily appreciated.

First, the threaded sleeve 148 (FIG. 10) is selectively rotatably adjusted on the push-pull rod 100, thereby setting the maximum stroke length of the push-pull rod 100 (connected to the diaphragm of actuator 102) and thereby setting the lowest (maximum) depth at which the model submarine 10 may fully submerge (after receiving a command signal).

Second, the model submarine is placed in water with the motor-pump unit 32 switched "off" and not running. The seal screw 96 is opened, thereby allowing reference atmospheric air to fill tube 95, conduits 95A and 113, chamber 110 and accumulator 114. Once reference air is admitted, and the inner mechanism has thermally equilibriated with ambient water temperature, the screw 96 is closed. Closing of the screw 96 traps the air in chamber 110, thereby providing a reference for the operation of the automatic depth control mechanism 109.

The power system of the model submarine 10 is then activated by closing switches 18 and 19 to their "on" position, thereby enabling the battery 30 to power the motor-pump unit 32 and the receiver 50.

As previously noted, control of the model submarine 10 in the water is provided by radio signals from a hand-held radio transmitter (not shown) operated by the user and received by the multi-channel receiver 50 in the submarine 10. These R.F. signals are transmitted and received by the on-boar antenna 52 and are transmitted (via spring contact 55) to the coaxial signal cable 54 and thus to the receiver 50. The receiver 50, in turn, sends appropriate signals via contacts 57 to the valves 59, 60 and 115, respectively.

Propulsion of the model submarine 10 on or through the water (along with powering the hydraulic controls for maneuvering of the model submarine 10 is provided solely by the single (submersible) motor-pump unit 32. The motor-pump unit 32 draws ambient water into its inlet port 35 from the free-flooding hull 11. The ambient water drawn in by the motor-pump unit 32 is pressurized and is discharged through the outlet port 33 and conduit 44 into the ejector pump 45. As the water flows out of the discharge nozzle 46 of the ejector pump 45, a reaction is created which propels the model submarine 10 forwardly in the water.

As the water flows out of the discharge nozzle 46 and past the venturi 45A of the ejector pump 45, a suction is created in the port 47 which, in turn, creates a vacuum (negative pressure) in the suction conduit 48. This vacuum aspirates (or draws) either water (or air) out of the ballast tank 22, through conduit 48 and suction port 47 and into the ejector pump 45, where the water (or air) mixes with pressurized water from conduit 44 for discharge out of the model submarine 10. Water or air drawn from the inside of the ballast tank 22 is replaced with either air vented into the ballast tank 22 (via periscope 13 and vent hose 49, respectively) or with water, if the top of the periscope 13 is submerged. If the plug valve 83 is unseated from its valve seat (aperture 84) the dimensions of the valve 83 and aperture 84 are such that water will flow into the ballast tank 22 at a rate greater than the rate at which the ejector pump 45 can draw water out of the ballast tank 22, thereby permitting the ballast tank 22 to fill with water, and thereby allowing the boat to submerge (to its periscope depth, just under the surface of the water). When the motor-pump unit 32 is at operating speed, a vacuum of approximately 29 inches of water is created inside the ejector pump 45.

Buoyancy is controlled via emptying and filling of the ballast tank 22. When the ballast tank 22 is empty, the suction conduit 48 draws air from the lowermost point 28 of the ballast tank 22 and carries the air to the ejector pump 45, where the air mixed with pressurized water from conduit 44 and is ejected (under pressure) from the ejector pump 45. Air drawn from the ballast tank 22 is replaced by air from the atmosphere, drawn through the periscope 13; the periscope 13 doubles as a telescopic vent tube connected by a hose 49 to the uppermost point 29 of the ballast tank 22.

With the motor-pump unit 32 energized (turned "on") the suction conduit 48 always draws either water and/or air from the lowermost point 28 of the ballast tank 22. The suction conduit 48 has its uppermost point above the water line, when the submarine 10 is surfaced. This prevents water from siphoning back into the ballast tank 22 from the ejector pump 45, when the submarine 10 is surfaced and the motor-pump unit 32 is not running.

To dive to "periscope depth", the appropriate command (in the form of a radio signal from the user's transmitter) is sent to the multi-channel receiver 50. The receiver 50, in turn, sends a momentary signal to the forward coil 61 of the ballast solenoid control valve 59 (FIG. 8). Energizing the fore coil 61 causes the spool 66 in valve 59 to shift to its forward position, (FIG. 7A) where the spool 66 will remain until the aft coil 62 is energized (FIG. 7B).

With the spool 66 in its forward position, filtered water from outlet port 34 of the motor-pump unit 32 (FIG. 4) flows to the aft chamber 80 of the ballast tank actuator 77 via conduit 91 at approximately 3 p.s.i.g. of water pressure (FIG. 7B) thereby driving the ballast tank actuator diaphragm 81 forward, moving shaft 82 from its first (closed) position and into its second (open) position, and thereby unseating the ballast tank plug valve 83 from its valve seat 84. With valve seat 84 open, water from the forward chamber 79 of the ballast tank actuator 77 escapes to the ambient environment in the hull 11 through the conduit 92, tube 74, annular groove 67A, and downwardly-extending bore or tube 76 formed in the ballast control valve 59 (FIG. 7A). With the ballast tank aperture plug 83 open, water floods the ballast tank 22 faster than it is being purged by the suction effect of the ejector pump 45. The sloped roof 24 of the ballast tank 22 assures that the ballast tank 22 floods completely. Air is vented to the atmosphere via the vent hose 49 and periscope 13, respectively. The submarine 10 is now at periscope depth, as shown in FIG. 15.

When the aft coil 62 of the ballast solenoid control valve 59 is actuated, the spool 66 shifts to the aft end (FIG. 7B) whereupon pressurized water (at approximately 3 p.s.i.g.) is directed to the forward chamber 79 of the ballast tank actuator 77 via conduit 93, annular groove 67B and conduit 92. This reseats the ballast tank plug valve 83. The continuous action of the ejector pump 45 draws water from the ballast tank 22. As long as the periscope 13 is exposed to the atmosphere, air will be drawn into the ballast tank 22 via vent hose 49. This will raise the model submarine 10 from its "periscope depth" to "full surface".

Radio control of the ballast system is simplified by introducing a microswitch 87 which, when activated, switches the polarity of coils 61 and 62. Retraction of the ballast tank plug valve 83 causes the shaft 82 (carrying the switch actuator 85) to trip the microswitch 87. This causes a reversal of the polarity of the coils 61 and 62 through a diode block in the receiver 50, so that a signal—identical to that which caused opening of the ballast tank plug valve 83—now causes the plug valve 83 to close, upon the subsequent transmission.

Diving below periscope depth is accomplished by the forward diving planes 14 located on the sail 12. Initially, the model submarine 10 is placed in the water with the power "off". The diving plane control system is equilibriated by opening the seal screw 96 (FIG. 10) which leads to a tube 95 serving both as a vent to the atmosphere and a mechanical support for the diving planes 14. With the seal screw 96 loosened, air at atmospheric pressure is admitted from tube 95 via small conduit 95A to the chamber 110 below air diaphragm 111. Accumulator chamber 114, which is preferably fabricated from a metal having high thermal conductivity, supplies additional reference air volume for sensitivity, thereby forming a part of the depth control system. After a few minutes in the water, the bulk of the reference air volume within the chamber 110 and accumulator 114 has achieved thermal and barometric equilibrium with the surrounding water and ambient air, respectively, and the depth control system may be sealed by tightening the seal screw 96.

The diving mode begins by starting the motor-pump unit 32. With the ballast tank plug valve 83 closed, the ejector pump 45, (via suction conduit 48) will draw air from the ballast tank 22, as the model submarine 10 is at maximum positive buoyancy. A radio signal from the operator activates the ballast tank solenoid control valve 59, which causes diaphragm actuator 77 to open the valve seat (aperture) 84 which then floods the ballast tank 22 with water at a greater rate than water can be removed by the ejector pump 45. With the ballast tank 22 flooded, the model submarine 10 reaches periscope depth; that is, only the periscope vent 13 and antenna 52 are visible above the water surface. At periscope depth, the forward diving planes 14 will have rotated to their zero angle of attack (or horizontal position). The downward force of the ambient water pressure on diaphragm 111 in reference actuator 109 (plus the downward force of spring 101B) is now balanced with the downward pulling force of spring 101A when diaphragm 106 is up as shown; so that at periscope depth, the forward diving planes 14 are substantially horizontal (corresponding to a zero angle of attack).

Should the submarine exceed periscope depth, the higher ambient water pressure in the surrounding water acting on diaphragm 111 will have the effect of distending the depth control diaphragm 111 downwardly. This causes the forward diving planes 14 to tilt upwardly (towards a positive angle of attack) thereby restoring the model to periscope depth. Any surfacing tendency is conversely compensated by the diaphragm 111.

To dive deeper than periscope level requires operator input to a diving control solenoid valve 60 in the form of a radio diving signal. The diving control solenoid valve 60 functions like the ballast control solenoid valve 59. When the on-board receiver 50 detects the radio diving signal, it activates the sliding spool 66 on the diving plane control valve 60 which causes pressurized water from the hydraulic system to be directed via conduit 108 to the upper chamber 104 of the diving plane actuator 102. This causes movement of the actuator diaphragm 106 downwardly (and concomitant downward extension of the spring 101A) which tilts the diving planes 14 downwardly into a negative angle of attack, thereby resulting in diving of the submarine 10. As the submarine 10 dives, the increase of ambient water pressure acting on the diaphragm 111 will cause the return of the forward diving planes 14 to a near horizontal position, where the higher spring tension force of spring 101A is again balanced by the higher pressure induced force on diaphragm 111. The submarine will automatically hold this deeper depth—via the higher balanced force between spring 101A and the combination of the higher force on diaphragm 111 and spring 101B—until either another signal is received, or until forward speed is lost. The net effect is that the model submarine 10 is capable of achieving and maintaining a pre-set depth with no operator input (other than the initial commands to flood the ballast tank 22 and to dive) thereby achieving automatic depth control.

Since the model submarine is slightly positively buoyant, the loss of forward speed from either cessation of operation of the motor-pump unit 32 or from striking a stationary object, reduces the dynamic forces on diving planes 14 to zero, causing the submarine 10 to rise to its periscope depth.

A "rise" signal from the operator will cause activation of the sliding spool 66 on the diving solenoid control valve 60, thereby sending water under pressure to the lower chamber 105 of the diving plane actuator 102 via conduit 107. This distends the actuator diaphragm 106 upwardly, relaxing tension on spring 101A, and causing the diving planes 14 to tilt upwardly to a positive angle of attack. The threaded sleeve or collar 148 can be raised or lowered on the push-pull rod 100, which connects the actuator diaphragm 106 to the spring 101A. The position of this collar 148 predetermines the depth of the model submarine 10 by limiting the extent to which the actuator diaphragm 106 and spring 101A can be distended downwardly by the entry of pressurized water into the upper chamber 104.

Steering control is provided by pressurized water being selectively diverted into either the forward chamber 135 (if a lefthand turn is desired) or the rearward chamber 136 (if a righthand turn is desired) of the steering diaphragm actuator 134, see FIG. 14, by a radio signal from the operator. This radio signal is received by the receiver 50 which activates either the left coil 116 or the right coil 117 of the flapper valve 115 (FIG. 12) thereby causing the corresponding pivotably-mounted flapper 129 (or 130) with its respective rubber seal 132 (or 133) to be attracted to its respective energized coil, thereby closing off front port 122 (or 125) of the hollow "T" tubes 120 and 121, respectively. Normally, pressurized water is pumped into the "T" tubes 120 and 121 via top ports 123 and 126, respectively. The water in the "T" tubes 120, 121 then can flow through the orifices at the bottom of tubes 123 and 126 (such as orifice 123A in FIG. 13) and into the ambient water in the hull via front ports 122 and 125, respectively. However, when either front port 122 or front port 125 is closed, the pressurized water will be forced out through its corresponding rear port 124 or 127, respectively, and into the appropriate hose 139 or 138, respectively, which carries it to the steering diaphragm actuator 134, thereby resulting in movement of the rudders 16.

For example, when a right turn radio signal is sent to the receiver 50, the left coil 116 of flapper valve 115 is energized. Energizing the left coil 116 attracts the flapper 129, so that the seal 132 closes the front port 122; and the hydraulic output of the pump is directed through the left hose 139 and into the rearward chamber 136 of the steering diaphragm actuator 134, thereby pushing diaphragm 137 forwardly. Water in the forward chamber 135 is pushed through conduit 138, into port 127, and out to ambient through the front port 125 of "T" tube 121.

Preferably, "T" tubes 120, 121 are embedded in the flapper valve 115 in which the coils 116 and 117 are also embedded. In the preferred embodiment, the orifice 123A has a constriction of a 0.010 inch diameter. The body of the "T" tubes 120 and 121 each has an 0.032 inch bore diameter. Water is introduced to the top ports 123 and 126 at about 3 p.s.i.g. The 0.010 inch diameter orifice 123A, restricts the flow of water into the flapper valve 115 to about 15 cubic centimeters per minute. This water flow exits front ports 122 and 125, if the solenoid coils 116 and 117 are de-energized. When the respective flappers 129 or 130 are sequentially activated, the respective seal 132 or 133 thereon (a 0.010 inch thick rubber pad) is brought into contact with a respective front port 122 or 125, thereby forcing the flow out the respective "T" tubes 120 or 121 through rear ports 124 or 127, respectively, and into the hoses 139 or 138, respectively, and to the appropriate chamber (either 136 or 135, respectively) of the steering diaphragm actuator 134.

Output from the motor-pump unit 32 provides thrust for propulsion and suction for water ballast evacuation. In addition, hydraulic outlet port 34 supplies the hydraulic pressure necessary to activate the ballast tank diaphragm actuator 77, diving plane diaphragm actuator 102, and steering diaphragm actuator 134. Other actuators could be supplied as well. The output from the port 34 is directed towards a check valve 36 which is normally open (so that air can be relieved from the pump housing during initial flooding) and closes when the pump is turned on. After pressurized water exits the valve 35 assembly through a first conduit 37, it enters a water filter 38. The filtered output of water is then directed to the various solenoid valves.

With reference to the remaining drawings, FIGS. 16–31, a second embodiment of the present invention is illustrated, wherein the respective diaphragm-type of hydraulic actuators 77, 102 and 134 (actuated by the solenoid-type of shuttle valves 59, 60 and flapper valve 115, respectively) are replaced by respective servo valves. [In these remaining drawings, like parts have been denoted by the same numerals used in FIGS. 1–15.]

Figure 22:
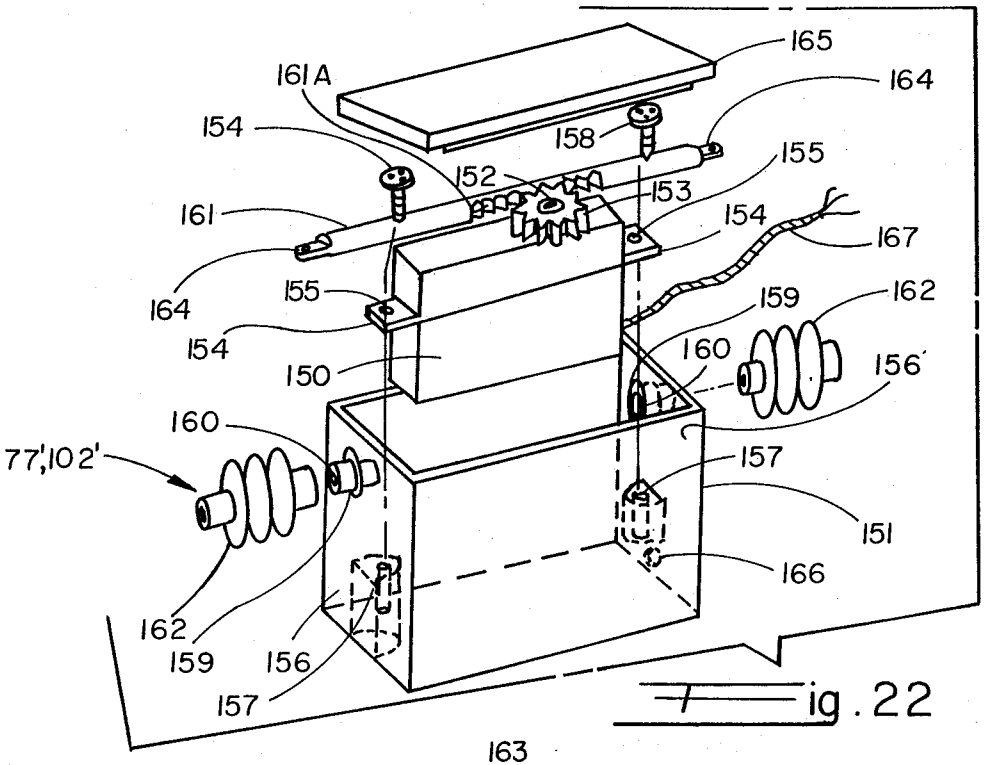
FIG. 22 is an exploded perspective view of one of the water-tight proportional servo motors of the second embodiment of the present invention.
Figure 24:
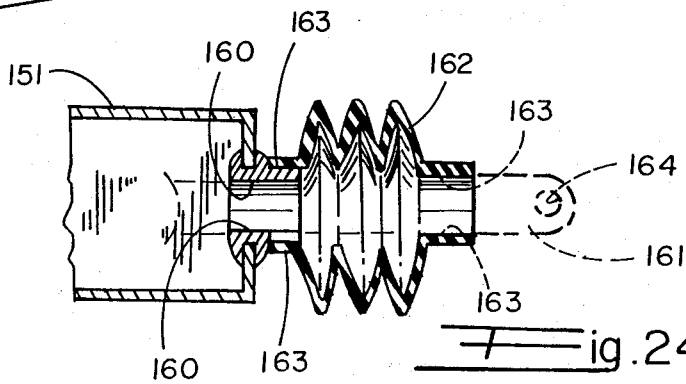
FIG. 24 is a cross-sectional view of a portion of the servo motor, taken along the lines 24—24 of FIG. 23 and drawn to an enlarged scale.
Figure 21A:
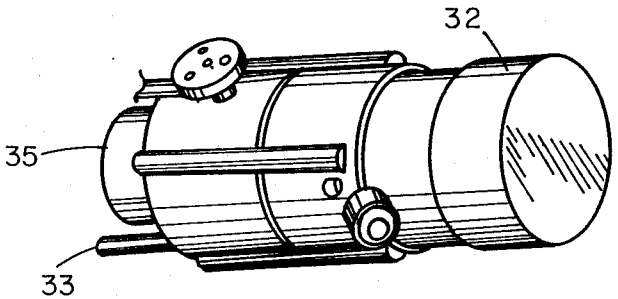
FIGS. 21A and 21B are perspective views of the motor-pump unit thereof.
Figure 21B:
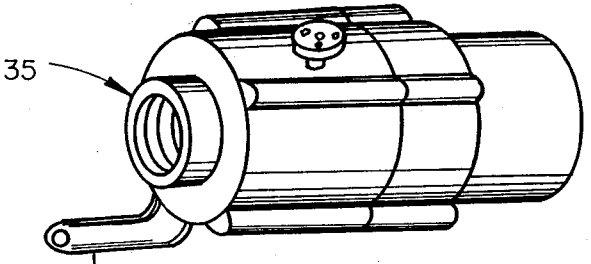
Figure 23:
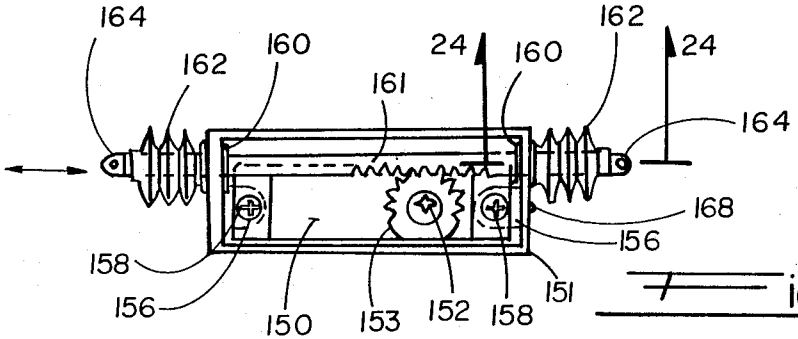
FIG. 23 is a top plan of the servo motor of FIG. 22, the lid being removed therefrom for ease of illustration.
Figure 25:
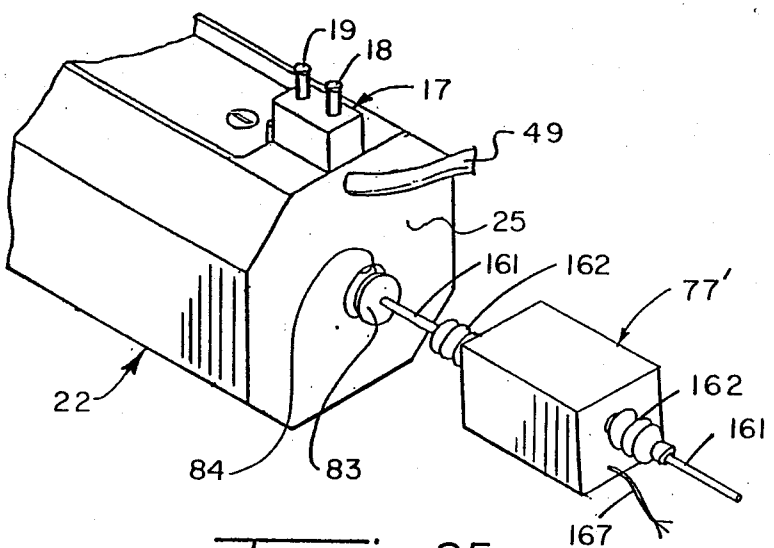
FIG. 25 is a perspective view, with parts broken away, of the ballast tank actuator system of the second embodiment (removed from the hull for ease of illustration).
Figure 26:
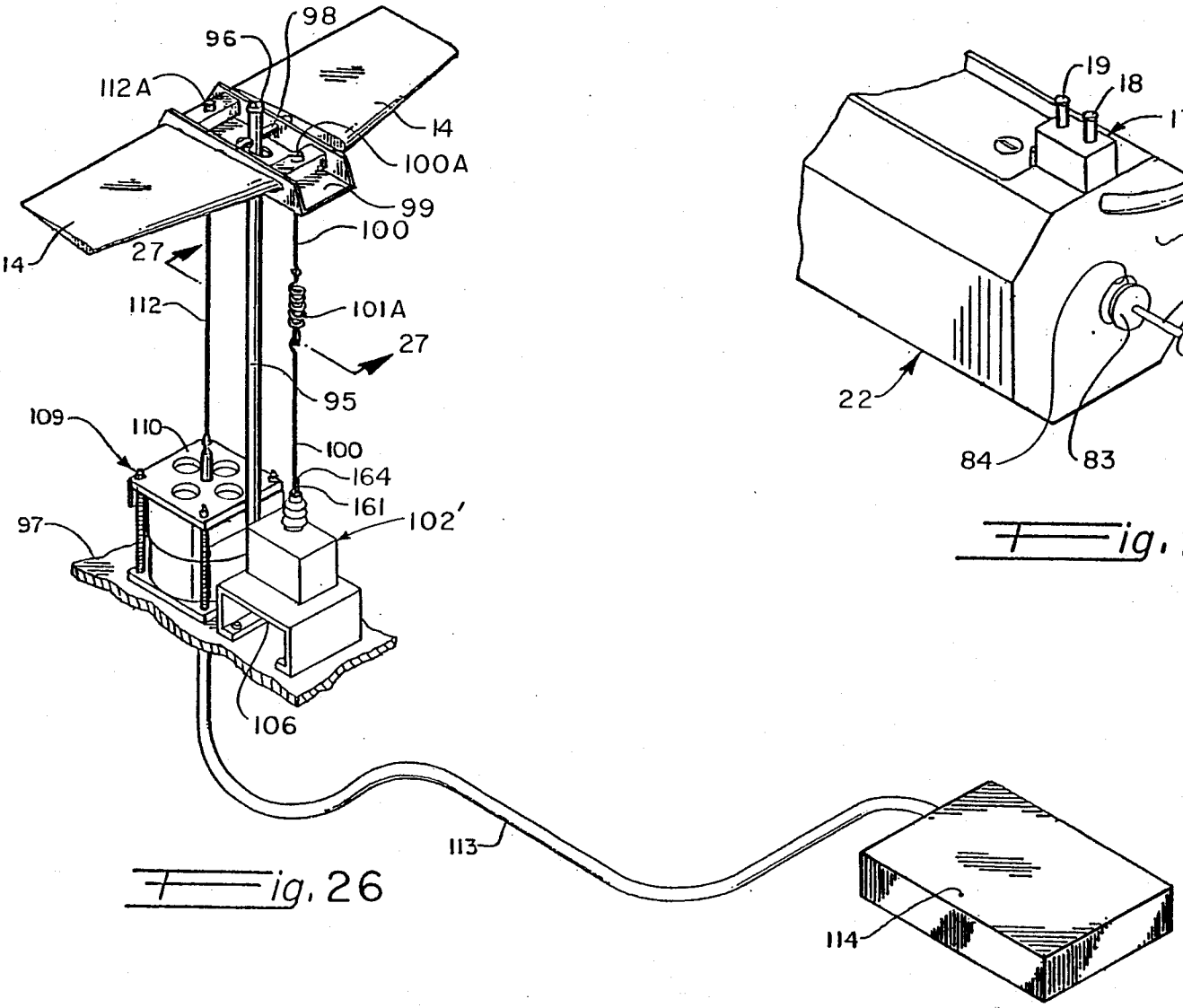
FIG. 26 is a perspective view of the diving plane servo actuator and the automatic depth control system of the second embodiment (again, as removed from the hull for ease of illustration).

With particular reference to FIGS. 22–24, each of the actuators 77', 102' and 134' includes a servo motor 150. The servo motor 150 may be the "FATUBA S33" servo motor manufactured by The Fatuba Corporation (of Japan). The servo motor 150 is contained in a housing 151, which preferably is formed of plastic or some other non-permeable water-resistant material. Mounting tabs 154 on the servo motor 150 have respective apertures 155 to receive screws 158. The screws 158 are received in tapped bosses 157 formed on the side walls 156 of the housing 151, thereby retaining the servo motor 150 in the housing 151.

The servo motor 150 rotatably drives a shaft 152 carrying a pinion 153. The pinion 153 cooperates with a rack 161A on a shaft 161. The shaft 161 is slidably received through respective bushings 160 in aligned openings 160 in the side walls 156 of the housing 161. The alternate rotational movement of the pinion 153 is translated into a longitudinal push-pull movement of the shaft 161. A respective bellows 162 is secured over each bushing 160 (by an adhesive 163 shown in FIG. 24) and bellows 162 extends outwardly from the housing 151. The opposite ends of the shaft 161 extend beyond the respective bellows 162, and apertures 164 are formed on the ends of the shaft 101, respectively. A lid 165 is adhesively bonded to the housing 151 to make the housing 151 watertight. Preferably, the adhesives (sealing means) are all watertight, and each bellows 162 is formed of a suitable elastomeric material. An aperture 166 in the housing 151 receives the lead wires 167 to energize the servo motor 150. The lead wires 167 connect with the receiver 50 via the multipin contacts 57 to receive the drive commands from receiver 50. The aperture 166 is made watertight by a seal 168, preferably using silicone "RTV" (room temperature vulcanized) material. One of the apertured ends 164 of the alternately reciprocating shaft 161 is connected to the flood control valve 83 (FIG. 25) thereby controlling the flooding of the ballast tank 22.

Similarly, the actuator 102' (FIG. 26) has a servo motor (similar to servo motor 150 of the actuator 77' of FIG. 22) for the purpose of diving control (as previously described with respect to the preferred embodiment of FIGS. 1–15).

The flapper valve 115 and diaphragm actuator 134 (used for steering control of the rudder 16 in the preferred embodiment of FIGS. 1–15) are replaced by a servo motor 169 in the alternate embodiment of the present invention illustrated in FIGS. 18–31. Here again, the servo motor 169 may be the "FATUBA S33" servo motor manufactured by the Fatuba Corporation (of Japan). The servo motor 169 is housed in a housing 170 which, again, is preferably of plastic or other suitable non-permeable water-resistant non-conductive material. The servo motor 169 has mounting tabs 173 provided with respective apertures 174; and screws 177 are received through the apertures 174 and into tapped recesses 176 in respective bosses 175 in the housing 170, thereby securing the servo motor 169 in the housing 170 (see FIG. 29). A lid 178 is bonded to the housing 170 to make the housing 170 watertight.

Servo motor 169 has a rotatable shaft 171 which carries a "master" driving magnet 172. A "slave" magnet 179 is rotatably mounted on the lid 178. The slave magnet 179 has respective poles which are aligned diametrically opposite to the poles of the driver magnet 172. Slave magnet 179 is driven concomitantly with the movement of the driver magnet 172 in response to drive signal commands. Preferably, slave magnet 179 is carried by a spindle 180 (formed from brass or other suitable non-magnetic material) and spindle 180 is mounted on the lid 178 by a water-tight adhesive 181. A bushing 182 (formed, preferably, from "TEFLON" or its equivalent) is press-fitted within slave magnet 179 and is rotatably mounted on the spindle 180. A cap 183 is soldered (or bonded) to the top of spindle 180 (above the slave magnet 179) thereby retaining the slave magnet 179 in place on the spindle 180. An aperture 184 in the lower portion of the housing 170 receives the lead wires 185 for the servo motor 169. The lead wires 185 are connected to the receiver 50 via the multipin contacts 57 to receive the drive signal commands from the receiver 50. The aperture 184 has a watertight sealant, such as a silicone "RTV" (room temperature vulcanized) sealant 186.

Figure 28:
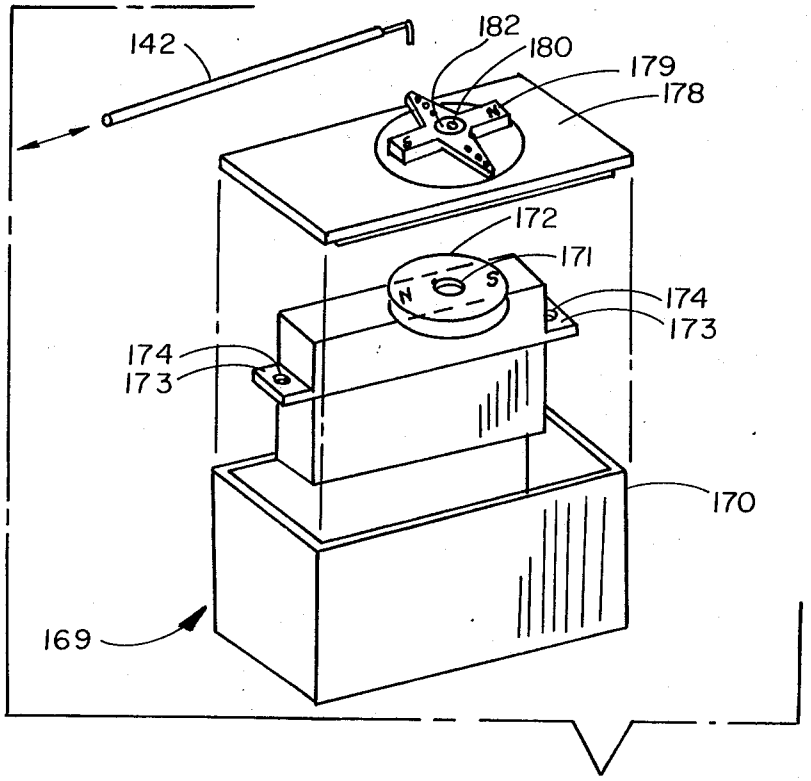
FIG. 28 is an exploded perspective view of another one of the proportional (watertight) servo motors of the second embodiment of the present invention (used in lieu of the flapper valve in the previous embodiment).
Figure 29:
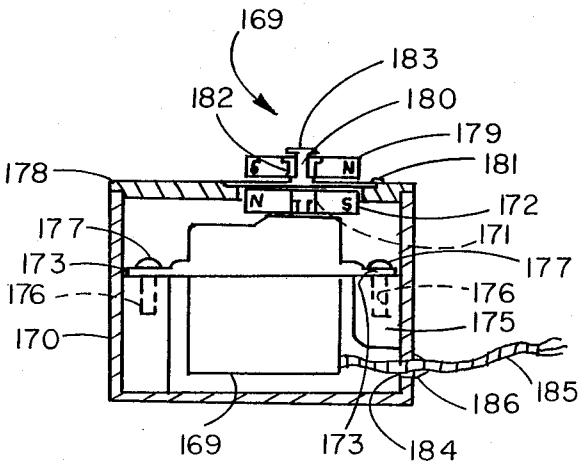
FIG. 29 is a longitudinal cross-sectional view thereof.
Figure 31:
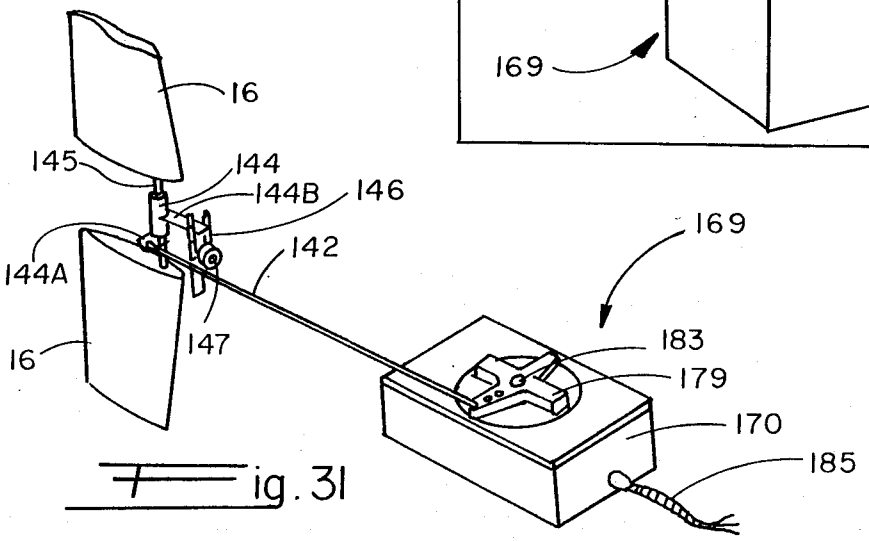
FIG. 31 is a perspective view of the rudder actuator system of the second embodiment (removed from the hull for ease of illustration).
Figure 30:
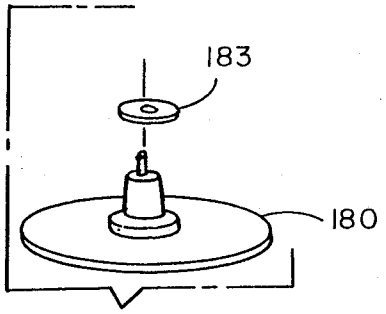
FIG. 30 is an exploded perspective view of the spindle and slave magnet arrangement of the servo motor of FIG. 28.

Referring to FIGS. 28 and 31, a steering rod 142 has its forward end suitably secured to the slave magnet 179 for movement therewith. The rearward end of the steering rod 142 is suitably secured to a first arm 144A of an "L"-shaped sleeve 144 carried by a steering shaft 145. Steering shaft 145 is disposed through the rearward portion of the hull 11 (on a vertical axis, substantially perpendicular to the longitudinal axis of the model submarine 10). Steering shaft 145 carries the respective upper and lower rudders 16 for conjoint movement therewith. Movement of the second arm 144B of the sleeve 144 is aligned with a spring mounting bracket 146. Carried on the spring mounting bracket 146 is a torsion spring 147. This torsion spring 147 acts to bias movement of the arm 144B by constantly urging the arm 144B, sleeve 144 and steering shaft 145, and thus rudders 16 towards their neutral position substantially aligned with the longitudinal axis of the hull 11.

To submerge to "periscope" depth, the appropriate command radio signal from the user's transmitter is sent to the multi-channel receiver 50. The receiver 50, in turn, sends a signal to the ballast tank servo actuator 77' (see FIG. 22) via wires 167 (FIG. 19) and multipin contacts 57, which activates the servo motor 150 to rotate shaft 152 (and pinion 153 thereon) through an angle in one direction. Pinion 152, through rack 161A, drives shaft 161 from its first (closed) position into its second (open) position, thereby unseating the ballast tank (flood control) aperture plug valve 83 from its valve seat 84. With the ballast tank aperture 84 open, water floods the ballast tank 22 faster than water is being purged out of the ballast tank 22 by the suction action of the ejector pump 45 (as previously described with respect to the first embodiment of the present invention). The sloped roof 24 of the ballast tank 22 assures that the ballast tank 22 floods completely; and air is vented to the atmosphere via the vent hose 49 and periscope 13, respectively.

To fully surface the submarine, the appropriate command radio signal is transmitted to the receiver 50 which, in turn, sends a signal to the ballast tank servo actuator 77' via wires 167 and multipin contacts 57 to thereby activate the servo motor 150. The servo motor 150 rotates shaft 152 and its pinion 153 in a second (opposite) direction. The pinion 153 drives the shaft 161 (via rack 161A) from its second (open) position and into its first (closed) position, thereby reseating the ballast tank aperture plug valve 83. The continuous action of the ejector pump 45 draws water from the ballast tank 22; and as long as the periscope 13 is exposed to the atmosphere, air will be drawn into the ballast tank 22 via vent hose 49. This will raise the model from its "periscope" depth to its "full surface" depth.

Figure 27:
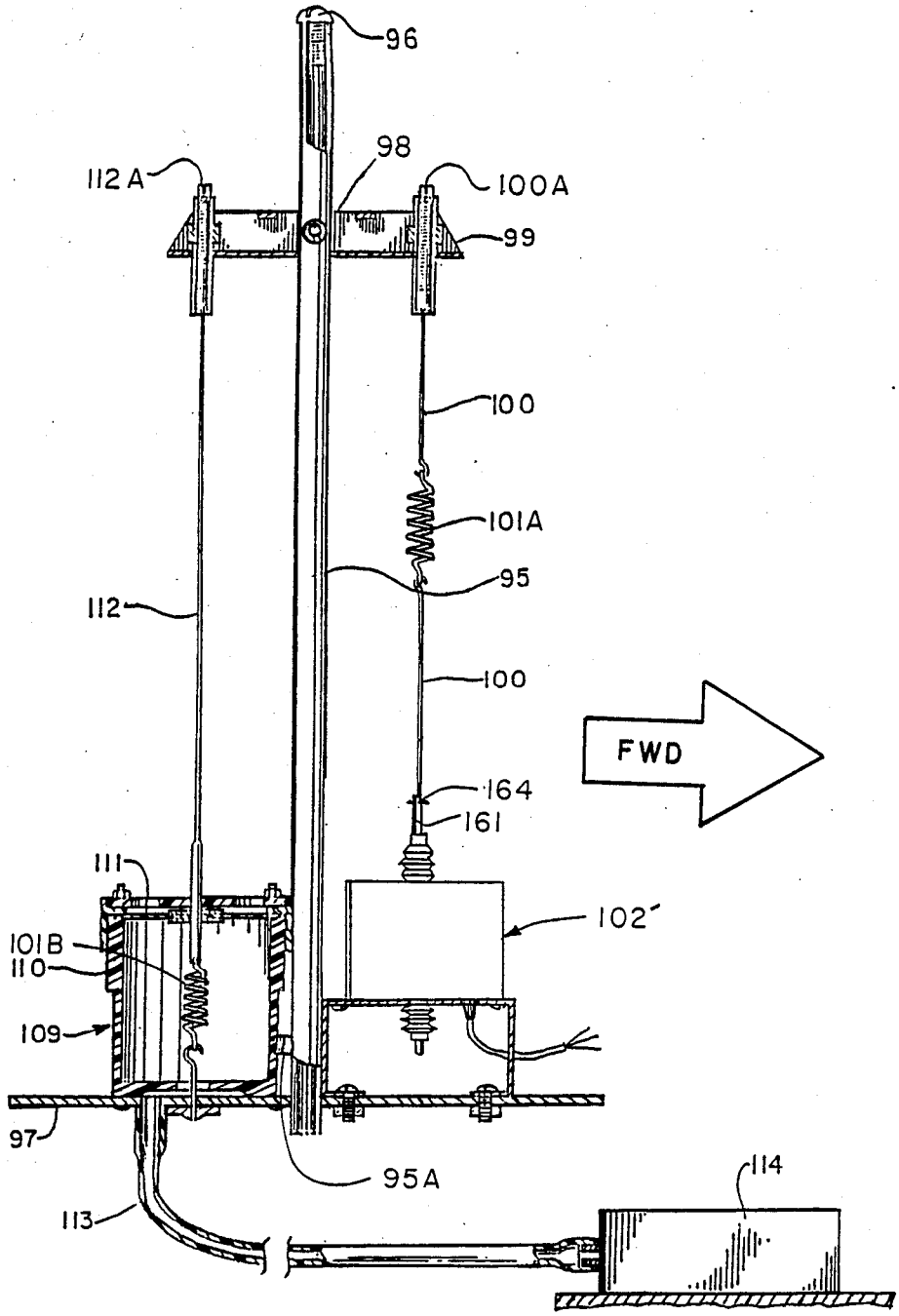
FIG. 27 is a longitudinal cross-sectional view, taken along the lines 27—27 of FIG. 26 and drawn to an enlarged scale.

In order to dive deeper than periscope level, the operator sends a proportional radio command "diving" signal to the on-board receiver 50 to provide an input to the diving plane servo actuator 102' (FIG. 27). The diving plane servo actuator 102', which functions in the same manner as the ballast tank servo actuator 77', moves the shaft 161 (secured to the lower end of push-pull rod 100) to a stroke length proportional to the radio command signal. The spring 101A is pulled proportionately downwardly, increasing the tension thereof. The resilient biasing action of spring 101A concomitantly pulls the upper portion of push-pull rod 100 proportionately downwardly which, in turn, tilts the forward diving planes 14 downwardly towards a proportionately negative angle of attack, thereby resulting in diving deeper. As the model submarine 10 dives, the increase of water pressure on the diaphragm 111 will gradually cause the return of the forward diving planes 14 to a near horizontal position. The model submarine 10 will automatically hold this deeper depth via the balanced forces of spring 101B and diaphragm 111 acting against spring 101A, until another radio command signal is received to change the spring tension (or until forward speed is lost).

Since the model submarine 10 is slightly positively buoyant, the loss of forward speed in the event that the motor-pump unit 32 ceases to operate, or in the event the boat 10 strikes a stationary object, causes the dynamic forces acting on the diving planes 14 to reduce to zero; and the model submarine 10 will surface to its periscope depth—where the air weight of that portion of the periscope and antenna above the surface of the water is equal to the positive buoyancy of the boat when the ballast tank 22 is fully flooded.

A "rise" signal from the operator will cause activation of the diving plane servo actuator 102' to move the shaft 161 back into an upward position proportional to the signal command. This movement concomitantly moves the lower portion of push-pull rod 100 proportionally upwardly, decreasing the tension of spring 101A proportionally, and allowing the upper portion of rod 100 to move proportionately upwardly which, in turn, causes the diving planes 14 to pitch upwardly to a proportionate positive angle of attack.

Steering is provided by movement of the respective magnets 172 and 179 of the steering actuator 169 (FIGS. 28 and 31) in response to a proportional radio signal received from the operator. This radio signal is received by the receiver 50 for a proportional rotation of the shaft 171, and hence the driver magnet 172 carried thereon. Rotational movement of the driver magnet 172 rotates the slave magnet 179 therewith in either a first direction or in a second (opposite) direction. Rotational movement of the slave magnet 179 proportionately moves the rearward steering rod 142. Steering rod 142 is secured to the first arm 144A of the L-shaped sleeve 144 that, in turn, carries the steering shaft 145 carrying the rudders 16 thereon, thereby resulting in movement of the rudders 16 for the desired steering of the model submarine 10.

For example, when a 10 degree left turn radio signal is sent to the receiver 50, the receiver 50 activates rotation of the shaft 171 (10 degrees c.c.w.) which carries the driver magnet 172 thereon 10 degrees c.c.w. (FIG. 31). Concomitant with the movement of the driver magnet 172, the slave magnet 179 moves 10 degrees c.c.w. The movement of the slave magnet 179 (which is secured to the forward end of the rod 142) moves the rod forwardly. This forward movement of rod 142 pulls the first arm 44A of sleeve in a forward direction, rotating the shaft 145 (having the rudder 16 thereon) in a counterclockwise direction about the longitudinal axis of the shaft 148, thereby resulting in a proportional lefthand turn.

When a righthand turn proportional radio signal (of say 20 degrees) is sent to the receiver 50, the receiver 50 activates proportional rotation of the shaft 171, which carries the driver magnet 172 thereon 20 degrees c.w.

Concomitant with the movement of the driver magnet 172, the slave magnet 179 moves 20 degrees c.w. The movement of the slave magnet 179, which is secured to the forward end of rod 142, moves the rod 142 rearwardly. This rearward movement of rod 142 pushes the first arm 144A of the sleeve in a rearward direction, rotating the shaft 145 (having the rudder 16 thereon) in a clockwise direction about the longitudinal axis of the shaft 148, thereby resulting in a proportional righthand turn.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A model submarine comprising a hull provided with a sail and a periscope, the hull having a plurality of apertures formed therein, such that ambient water may enter through the apertures, and such that the interior of the hull is free-flooding, a sealed battery within the hull, a single submersible motor-pump unit within the hull and adapted to be energized by the battery, the motor pump-unit having an intake means in communication with the interior of the hull and further having a pressurized discharge means; whereby the motor-pump unit, when energized, continually draws ambient water out of the free-flooding hull, and whereby the ambient water is replenished in the hull through the apertures therein, an ejector pump carried by the hull, the ejector pump having an inlet port connected to the pressurized discharge means of the motor-pump unit and further having a discharge nozzle communicating with the ambient water externally of the hull, such that the continuous discharge of the ambient water out of the hull through the discharge nozzle of the ejector pump facilitates the forward propulsion of the submarine in the water, a ballast tank within the hull, conduit means communicating the ballast tank with the ejector pump and including a vacuum port, whereby when the ejector pump discharges pressurized water through its discharge nozzle and out of the hull, a suction is created in the vacuum port, thereby causing the ejector pump to aspirate fluid out of the ballast tank, a selectively-operable flood control valve means including a first diaphragm actuator for communicating the ballast tank with the interior of the free-flooding hull upon a given command; wherein when the flood control valve means is actuated, water flows into the ballast tank at a faster rate than the rate at which water is aspirated out of the ballast tank by the ejector pump, such that the ballast tank becomes completely filled with ambient water, buoyancy means within the free-flooding hull and adapted to trim the submarine to a slightly positive buoyancy when the ballast tank is fully flooded, such that the submarine is still slightly buoyant and is adapted to partially submerge to a periscope depth just under the surface with only its periscope above the water, articulatable diving planes carried by the submarine externally thereof and adapted to have a neutral position defined by a substantially zero angle of attack, selectively-operable diving actuating means including a second diaphragm actuator communicating with the pressurized discharge of the motor-pump unit for articulating the diving planes to a negative angle of attack to cause the submarine to dive below periscope depth upon another given command, means responsive to ambient water pressure for sensing the depth to which the submarine has submerged, thereby providing a force which increases at greater depths for countering the second diaphragm actuator and causing the diving planes to again assume a substantially neutral position when the desired depth has been obtained, such that the submarine will substantially level off and maintain its submerged depth until a new command is given to the articulatable diving planes, a rudder on the hull, selectively-operable steering control means including a third diaphragm actuator in communication with the pressurized discharge of the motor-pump unit for controlling the rudder upon a further command; each of the first, second and third diaphragm actuators having respective sides; the respective selectively-operable flood control valve means, diving initiating means, and steering control means being adapted to admit pressurized water from the discharge means of the motor-pump unit to one side or the other of the first, second and third diaphragm actuators, respectively, for selectively controlling the submerging, diving and steering of the submarine, respectively; and a receiver means on the submarine for receiving the command signals from a remote transmitter for selectively controlling the flood control valve means, diving initiating means, and steering means, respectively; whereby the submersible motor-pump unit, supplying the pressurized water, constitutes the sole power source for forward propulsion of the submarine, for taking on and discharging water ballast for surfacing, and for diving and steering, respectively; and whereby if the submarine engages an obstruction, or if the motor-pump unit fails, or if the battery becomes discharged while the submarine is fully submerged within the water, the submarine is adapted to automatically rise within the water to its periscope depth, thereby providing a fail-safe feature and enabling the submarine to be retrieved conveniently.

2. The model submarine of claim 1, wherein the free-flooding hull has top and bottom surfaces, and wherein the plurality of the apertures comprise vent holes formed in both the top and bottom surfaces, respectively.

3. The model submarine of claim 1, wherein the hull includes a watertight compartment for housing the receiver means, and wherein the remainder of the hull is completely free-flooding.

4. The model submarine of claim 1, wherein the buoyancy means comprises closed cell rigid foam for trimming the submarine to a slightly positive buoyancy when the ballast tank is fully flooded, and wherein the styrofoam is placed within the hull such that the respective vectors for the center of buoyancy and the center of gravity fall on substantially the same vertical line.

5. The model submarine of claim 4, wherein the center of buoyancy disposed above the center of gravity.

6. The model submarine of claim 1, wherein the sealed battery is disposed within the ballast tank, the ballast tank thereby forming a shroud for the battery, and wherein the battery and the ballast tank are located substantially at the center of the hull, thereby minimizing pitching movements as the ballast tank is flooded or is being purged.

7. The model submarine of claim 1, wherein the motor-pump unit comprises an encapsulated motor driving a centrifugal impeller pump.

8. The model submarine of claim 1, wherein the hull has a lower aft portion, the ejector pump being mounted in the lower aft portion of the hull, and wherein the discharge nozzle of the ejector pump extends externally of the hull.

9. The model submarine of claim 1, wherein the water intake means of the motor-pump unit is provided with a screen.

10. The model submarine of claim 1, wherein the diaphragm actuators have respective solenoid-actuated shuttle valves, and wherein the pressurized discharge port of the motor-pump unit has a main portion connected to the ejector pump, and further has auxiliary portions connected to the respective solenoid-actuated shuttle valves.

11. The model submarine of claim 10, wherein the ejector pump includes a venturi portion communicating with the vacuum port in the conduit to the ballast tank, thereby aspirating water or air out of the ballast tank as the water flows from the main portion of the pressurized discharge port of the motor-pump unit and out of the discharge nozzle of the ejector pump.

12. The model submarine of claim 1, wherein the selectively-operable flood-control valve means comprises a first solenoid-actuated shuttle valve having an input connected to the pressurized discharge of the motor-pump unit and further having a pair of outputs, each of which is connected to a respective side of the first diaphragm actuator, an actuator rod carried by the first diaphragm actuator, a ballast tank flood control valve carried by the actuator rod, the ballast tank having an inlet port provided with a valve seat cooperating with the ballast tank flood control valve, and the control valve and inlet port being sufficiently large to allow ambient water to enter into the ballast tank from the free-flooding hull, when the control valve is lifted off its valve seat, at a faster rate than the rate at which water is aspirated out of the ballast tank by the ejector pump.

13. The model submarine of claim 12, wherein the first solenoid-actuated shuttle valve comprises a pair of spaced-apart solenoid coils and a spool adapted for limited reciprocation between the coils, the spool having two alternate positions.

14. The model submarine of claim 13, wherein the solenoid-actuator shuttle valve further comprises a main body portion disposed between the spaced-apart solenoid coils, the main body portion having the pressurized input port and a pair of output ports formed therein, and further having a pair of vent openings communicating with the interior of the free-flooding hull; the spool reciprocating transversely of the main body portion, and the spool having a series of spaced-apart external annular grooves formed thereon; whereby in one of the alternate positions of the spool, the pressurized water input is connected through the pressurized input port to one of the output ports and thence to one side of the first diaphragm actuator, and the other side of the first diaphragm actuator is connected through the other of the output ports to one of the vent openings, thereby opening the control valve, and thereby allowing the submarine to submerge to its periscope depth; and whereby in the other alternate position of the spool, the pressurized water input is connected through the other output port to the other side of the first diaphragm actuator, and the one side of the first diaphragm actuator is connected through the other output port to the other of the vent openings, thereby closing the ballast tank flood control valve, and thereby allowing the submarine to surface.

15. The model submarine of claim 1, wherein the submarine further includes a sail, the periscope projecting upwardly beyond the sail, and wherein the articulatable diving planes are carried by the sail.

16. The model submarine of claim 15, wherein a pivot arm is mounted within the sail and is connected to the articulatable diving planes for conjoint pivotable movement, the pivot arm having a pair of ends; and wherein the selectively-operable diving initiating means comprises a second solenoid actuated shuttle valve having a pressurized input connected to the pressurized auxiliary discharge of the motor-pump unit, the solenoid-actuated shuttle valve having a pair of outputs connected to the sides of the second diaphragm actuator, respectively, a vertical push-pull rod carried by the second diaphragm actuator and connected through a tension spring to one end of the pivot arm; and wherein the other end of the pivot arm is connected to the means responsive to ambient water pressure for sensing the depth to which the submarine has submerged.

17. The model submarine of claim 16, wherein the means responsive to ambient water pressure for sensing the depth to which the submarine has submerged, comprises a second vertical rod having a pair of ends, one of which is connected to the other end of the pivot arm, a reference actuator mounted on a base and including an air diaphragm carried by the second rod, the actuator including an upper portion above the air diaphragm and a lower portion below the air diaphragm, the lower portion of the actuator defining an entrapped air chamber therein, the upper portion of the actuator having an opening formed therein and communicating with the interior of the free-flooding hull, thereby admitting water into the upper portion of the actuator when the submarine is in the water, thereby sensing the trapped air pressure in the lower portion of the actuator, a second spring disposed in the reference actuator and connected between the base and the other end of the second rod, thereby generating a counterforce tending to balance the force of the spring on the vertical push-pull rod connected to the second diaphragm actuator and thereby tending to pivot the pivot arm and hence the diving planes connected thereto to a lesser negative angle of attack, the magnitude of the counterforce increasing at increasing depths to which the submarine is submerged.

18. The model submarine of claim 17, wherein a depth limiting collar is threadably received on the first vertical rod connected to the diaphragm actuator, whereby the position of the collar on the first rod may be adjusted, and whereby the collar is adapted to engage the actuator to provide a stop, thereby limiting the extent to which the first rod may be lowered, thereby limiting the pivotable movement of the pivot arm and the diving planes connected thereto, and thereby providing an adjustable depth limiting feature for the submarine.

19. The model submarine of claim 1, wherein the hull has an aft portion provided with fixed diving planes, the fixed diving planes serving as a stabilizer.

20. The model submarine of claim 1, wherein the rudder comprises an upper rudder and a lower rudder, respectively, a pivot rod joining the upper and lower rudders, an eccentric arm carried by the pivot rod between the upper and lower rudders, a horizontal push-pull rod having a pair of ends, one of which is connected to the eccentric arm, and the other end of which is connected to the third diaphragm actuator, and resilient means biasing the third diaphragm to its central neutral position, thereby returning the rudders to their neutral position when the steering command is removed.

21. The model submarine of claim 20, further including a flapper valve for controlling the third diaphragm actuator.

22. A model submarine comprising a hull provided with a periscope, the hull having a plurality of apertures formed therein, such that ambient water may enter through the apertures, and such that the interior of the hull is free-flooding, a sealed battery within the hull, a submersible motor-pump unit within the hull and adapted to be energized by the battery, the motor-pump unit having an intake means in communication with the interior of the hull and further having a pressurized discharge means; whereby the motor-pump unit, when energized, continually draws ambient water out of the free-flooding hull, and whereby the ambient water is replenished in the hull through the apertures therein, an ejector pump carried by the hull, the ejector pump having an inlet port connected to the pressurized discharge means of the motor-pump unit and further having a nozzle communicating with the ambient water externally of the hull, such that the continuous discharge of the ambient water out of the hull through the nozzle of the ejector pump facilitates the forward propulsion of the submarine in the water, a ballast tank within the hull, conduit means communicating the ballast tank with the ejector pump and including a vacuum port, whereby when the ejector pump discharges pressurized water out of the hull, a suction is created in the vacuum port, thereby causing the ejector pump to aspirate fluid out of the ballast tank, buoyancy means within the free-flooding hull and adapted to trim the submarine to a slightly positive buoyancy when the ballast tank is fully flooded, a first selectively-operable means responsive to a first command signal for communicating the ballast tank with the interior of the free-flooding hull, whereby water flows into the ballast tank at a faster rate than the rate at which water is aspirated out of the ballast tank by the ejector pump, such that the ballast tank becomes filled with ambient water, and such that the submarine is still slightly buoyant and is adapted to partially submerge to a periscope depth just under the surface with its periscope above the water, articulatable diving planes carried by the submarine externally thereof and adapted to have a neutral position defined by a substantially zero angle of attack, a second selectively-operable means responsive to a second command signal for articulating the diving planes to cause the submarine to dive below periscope depth, a rudder on the hull, a third selectively-operable means responsive to a third command signal for controlling the rudder, and a receiver means on the submarine for receiving the respective command signals from a remote transmitter for selectively controlling the first, second and third selectively-operable means, respectively.

23. The model submarine of claim 22, wherein at least one of the first, second and third selectively-operable means includes a solenoid-actuated shuttle valve.

24. The model submarine of claim 22, wherein at least one of the first, second and third selectively-operable means comprises a servo motor.

25. In a model submarine having diving and steering control mechanisms, respectively, the control mechanisms having a hydraulic fluid, the combination of a free-flooding hull and a single motor-pump unit in the hull, wherein the motor-pump unit provides the sole motive power for propulsion of the submarine and for the diving and steering maneuvers, respectively, and wherein ambient water in the free-flooding hull provides the hydraulic fluid for activating the diving and steering control mechanisms.

26. In a model submarine, the combination of a motor-pump unit energized by a battery, means assuring that the submarine will rise to periscope depth for convenient retrieval in the event that forward propulsion ceases, or in the event that the motor-pump unit fails or the battery is discharged, thereby providing a fail-safe feature, and manually-adjustable means for limiting the maximum depth to which the submarine may submerge.

27. In a model submarine, the combination of a sail, a pivot arm having a pair of ends and further having an intermediate portion pivotably mounted within the sail, articulatable diving planes carried by the pivot arm for pivotal movement in unison, a first vertical push-pull rod within the sail and having a pair of ends, a first actuator responsive to a pressurized water source initiated by a command signal to dive, the actuator including a diaphragm connected to one end of the push-pull rod, a tension spring having a pair of ends, one end of which is connected to the other end of the push-pull rod, and the other end of the spring being connected to one end of the pivot arm, a second vertical rod having a pair of ends, one of which is connected to the other end of the pivot arm, a second reference actuator mounted on a base and having a housing and further having an air diaphragm connected to the other end of the second vertical rod, the second actuator housing having at least one opening therein for admitting ambient water into the air diaphragm actuator on the side of the air diaphragm connected to the second vertical rod, the air diaphragm defining an entrapped air chamber in the air diaphragm actuator on the side thereof which is opposite to the second vertical rod; a second tension spring disposed in the reference actuator below the air diaphragm therein and connected between the base and the other end of the second verticaly rod, whereby, when a command signal has been given to the submarine to dive, the pressurized water source actuates the diaphragm in the first actuator to pull the push-pull rod downwardly, extending the spring, and pivoting the pivot shaft and hence the diving planes connected thereto in one direction for a desired negative angle of attack for diving of the submarine; and whereby the water admitted into the reference actuator generates a force which increases substantially proportionally to the increasing water pressure at the greater depths to which the submarine submerges, which, together with the force of the springs, causes the second vertical rod to move downwardly, thereby pivoting the pivot shaft in an opposite direction, and thereby causing the diving planes connected to the pivot shaft to assume a near neutral position, such that the submarine will continue in the water at its desired depth until a further, and opposite, command signal is provided.

28. In a model submarine, the combination of a free-flooding hull, a ballast tank within the hull, a sealed battery within the ballast tank, a submersible motor-pump unit within the hull and adapted to be energized by the battery in the ballast tank, the battery and ballast tank being disposed substantially centrally of the hull, the hull having closed cell rigid foam therein for trimming the submarine to a slightly positive buoyancy, such that the submarine when submerged with its ballast tank fully flooded will automatically rise to its periscope depth in the event that the motor-pump fails or if the battery is discharged, thereby allowing the submarine to be retrieved and providing a fail-safe feature.

29. In a model submarine, the combination of a free-flooding hull, a single ballast tank within the hull and having an envelope, a sealed battery shrouded within the ballast tank envelope, a submersible motor-pump unit within the hull and adapted to be energized by the battery in the ballast tank, the battery and ballast tank being disposed substantially centrally of the hull, the hull having a foam means therein for trimming the submarine to a slightly positive buoyancy with the ballast tank fully flooded, and the foam being disposed in the hull such that the center of buoyancy and the center of gravity vectors fall on substantially the same vertical line.

30. The combination of claim 29, wherein the center of buoyancy is above the center of gravity.

31. A model submarine, comprising a free-flooding hull having a ballast tank, a submarine motor-pump unit energized by a sealed battery in the free-flooding hull, respective control means in the hull for selectively controlling the submerging of the model submarine to its periscope depth, diving to a submerged depth, and steering of the model submarine, respectively, a receiver means on the model submarine for receiving remotely-transmitted command signals for selectively activating the control means, automatic depth control means for leveling off the submarine at a predetermined desired submerged depth after diving in response to a respective command signal, and fail-safe means assuring that the model submarine, in the event of a power failure or encountering an obstruction while submerged, will not sink to the bottom or burrow into the silt, but rather will rise to its periscope depth for convenient retrieval.

32. The model submarine of claim 31, further including adjustable means for limiting the maximum depth to which the model submarine may submerge upon receipt of a diving command signal.

33. The model submarine of claim 31, wherein the control means includes solenoid-actuated shuttle valves.

34. The model submarine of claim 33, wherein the shuttle valves control respective hydraulic diaphragm actuators, and wherein the diaphragm actuators are actuated by a pressurized ambient water discharge from the motor-pump unit and through the respective shuttle valves.

35. The model submarine of claim 31, wherein an ejector pump on the hull receives a pressurized ambient water discharge from the motor-pump unit, thereby facilitating forward propulsion of the model submarine.

36. The model submarine of claim 35 wherein the ejector pump includes a venturi for creating a negative pressure in a suction conduit leading to the ballast tank, thereby aspirating fluid out of the ballast tank, and wherein when the respective command signal is given to submerge the model submarine to its periscope depth, the respective control means opens a valve on the ballast tank to admit ambient water from the free-flooding hull into the ballast tank at a faster rate than the rate at which water is aspirated out of the ballast tank by the venturi of the ejector pump, such that the ballast tank becomes completely flooded.

37. The model submarine of claim 31, wherein the respective control means includes respective servo motors.

38. The model submarine of claim 31, wherein at least one of the respective control means comprises a respective flapper valve.

* * * * *